US010550606B2

(12) United States Patent
Hammerer

(10) Patent No.: US 10,550,606 B2
(45) **Date of Patent: *Feb. 4, 2020**

(54) EJECTION DEVICE FOR A MOVABLE FURNITURE PART

(71) Applicant: Julius Blum GmbH, Hoechst (AT)

(72) Inventor: Andre Hammerer, Alberschwende (AT)

(73) Assignee: Julius Blum GmbH, Hoechst (AT)

( * ) Notice: Subject to any disclaimer, the term of this patent is extended or adjusted under 35 U.S.C. 154(b) by 64 days.

This patent is subject to a terminal disclaimer.

(21) Appl. No.: 15/834,710

(22) Filed: Dec. 7, 2017

(65) Prior Publication Data

US 2018/0094457 A1 Apr. 5, 2018

Related U.S. Application Data

(63) Continuation of application No. PCT/AT2016/050142, filed on May 17, 2016.

(30) Foreign Application Priority Data

Jun. 9, 2015 (AT) ..... A 359/2015

(51) Int. Cl.
*E05B 63/22* (2006.01)
*E05F 1/10* (2006.01)
(Continued)

(52) U.S. Cl.
CPC ..... *E05B 63/22* (2013.01); *E05C 19/022* (2013.01); *E05F 1/10* (2013.01); *E05F 1/16* (2013.01); *E05Y 2900/20* (2013.01)

(58) Field of Classification Search
CPC ..... E05B 63/22; E05C 19/022; A47B 88/46; A47B 88/47; A47B 88/463; E05F 1/10; E05F 1/16
(Continued)

(56) References Cited

U.S. PATENT DOCUMENTS 5,319,519 A * 6/1994 Sheppard ..... H05K 5/0295 312/319.1
9,215,929 B2 12/2015 Brunnmayr
(Continued)

FOREIGN PATENT DOCUMENTS

AT 512 699 10/2013
CN 101674755 3/2010
(Continued)

OTHER PUBLICATIONS

International Search Report dated Aug. 16, 2016 in International (PCT) Application No. PCT/AT2016/050142.
(Continued)

*Primary Examiner* — James O Hansen
(74) *Attorney, Agent, or Firm* — Wenderoth, Lind & Ponack, L.L.P.

(57) ABSTRACT

An ejection device for a movable furniture part includes an ejection element that can rotate about a rotational axis and ejects the movable furniture part from a closed position into an open position, an ejection force storage element which applies a force to the ejection element, and a locking device for locking the ejection element in a locking position. The line of application of the ejection force storage element runs through the axis of rotation when in the locking position.

8 Claims, 20 Drawing Sheets

SS+VS+K

(51) Int. Cl.
*E05C 19/02* (2006.01)
*E05F 1/16* (2006.01)

(58) Field of Classification Search
USPC ..... 312/330.1, 334.1, 319.1, 319.2, 334.8
See application file for complete search history.

(56) References Cited

U.S. PATENT DOCUMENTS

| | | | | |
|---|---|---|---|---|
| 9,375,083 | B2 | 6/2016 | Haemmerle et al. | |
| 9,386,850 | B2 | 7/2016 | Dubach | |
| 9,428,950 | B2 | 8/2016 | Braungart | |
| 9,629,461 | B2 | 4/2017 | Egger | |
| 9,655,447 | B2 | 5/2017 | Brunnmayr et al. | |
| 2008/0191592 | A1* | 8/2008 | Dubach | E05B 65/46 312/319.1 |
| 2010/0084954 | A1 | 4/2010 | Schneider et al. | |
| 2011/0138801 | A1* | 6/2011 | Zimmer | A47B 88/457 60/527 |
| 2015/0374124 | A1 | 12/2015 | Brunnmayr et al. | |

FOREIGN PATENT DOCUMENTS

| | | |
|---|---|---|
| CN | 101680260 | 3/2010 |
| CN | 102917617 | 2/2013 |
| CN | 203524176 | 4/2014 |
| CN | 104125788 | 10/2014 |
| CN | 104364456 | 2/2015 |
| CN | 104684440 | 6/2015 |
| EP | 1 894 492 | 3/2008 |
| JP | 57-88861 | 6/1982 |
| WO | 2007/116572 | 10/2007 |
| WO | 2007/122067 | 11/2007 |
| WO | 2012/155165 | 11/2012 |
| WO | 2014/082106 | 6/2014 |
| WO | 2014/165877 | 10/2014 |

OTHER PUBLICATIONS

Search Report dated Feb. 23, 2016 in Austrian Application No. A 359/2015, with English translation.

* cited by examiner

SS + VS + K

US + ES + K

OS+ES+K

OS+ES+K

OS + ES + K

OS + ES + K

OS+ES+K

OS+ES+K

OS+ES+K

OS+VS+K

OS+VS+EK

OS+VS+EK+R

SS+VS+K+R

SS+VS+EK

US+ES+EK

OS+ES+EK

OS+ES+EK

OS+ES+K

OS+ES+K

OS+ES+K

OS+ES+K

OS+ES+K

OS+VS+EK

OS+VS+EK

OS+VS+EK

SS+VS+EK

OS+VS+EK+R

EJECTION DEVICE FOR A MOVABLE FURNITURE PART

BACKGROUND OF THE INVENTION

The present invention concerns an ejection device for a movable furniture part, comprising an ejection element for ejecting the movable furniture part from a closed position into an open position, the ejection element being rotatable about a rotary axis, an ejection force storage member force-actuating the ejection element and a locking device for locking the ejection element in a locking position. Moreover, the invention concerns an item of furniture comprising a furniture carcass, a movable furniture part and such an ejection device.

For many years, various auxiliary means have been produced and sold in the industrial sector of furniture fittings in order to support movements of the movable furniture parts and to facilitate movements for a user. For that purpose, especially in the case of ejection devices, various different variants already exist. Such ejection devices are also often referred to as touch-latch-mechanisms or as tip-on-devices. With such devices, it is possible to press onto the movable furniture part in a closed position, whereby an unlocking of a locking device is carried out and thereby or afterwards the movable furniture part is ejected by the ejection device.

For that purpose, for many years cardioid-shaped sliding guide tracks with a latch recess for a control pin have been proven for locking. As an example, AT 512 699 A1 teaches such an arrangement.

Moreover, there are locking devices which base on the ballpoint-pen-principle.

Another kind of a locking device is known from the WO 2014/082106 A1. This document teaches that in a locking position of an entrainment member, a movement of a latch into an unlocking position is restrained by a mechanic contact between the latch and the entrainment member. This mechanic contact between the latch and the entrainment member can be released by a movement of the movable furniture part against the opening direction, whereby the movable furniture part, in turn, is subsequently being ejected.

A further alternative variant of a locking device is known from the WO 2012/155165 A2. In a locking position, which is illustrated in FIG. 15, a central fold lever bolt of a fold lever is located above an imaginary line between a holding nose bolt and an ejection swiveling axis. If one is pressing in the closing direction onto the movable furniture part according to FIG. 16, an unlocking element abuts a part of the fold lever and, thereby, moves the fold lever bolt below the imaginary line between the ejection swiveling axis and the holding nose bolt. As a consequence, the spring force of the opening spring can relax. This means, the locking device is unlocked as soon as the fold lever bolt has crossed the dead center in the form of the imaginary line.

The non-generic WO 2007/116572 A1 teaches a device for supporting the sliding movement of a drawer. This document, however, does not show an ejection device for ejecting the drawer from a closed position, but rather shows a construction where the movement of a drawer from an already opened position into a still further opened position is being assisted.

SUMMARY OF THE INVENTION

The object of the present invention is to provide an alternative or improved ejection device compared to the prior art. In particular, the over-pressing path (gap size between the front panel and the furniture carcass) should be able to be as small as possible.

According to the invention, in the locking position, the line of action of the ejection force storage member runs through the rotary axis. In other words, such a locking position of a locking device can be compared with a labile position of a pendulum. The smallest forces or movements are sufficient to bring it out of the "labile" position corresponding to the locking position. The line of action represents a straight line which indicates the current location of a force (in this case the force of the ejection force storage member) in a space. Together with the sense of direction, this line of action amounts to the direction of action. When the line of action runs through the rotary axis, the ejection force storage member is not able to move the ejection element as there is no impetus for a rotation about the rotary axis. Thus, this ejection device forms a kind of a dead center locking. An undesired triggering or unlocking of this locking device by concussions is prevented by correspondingly adjusted frictions and inertias between the involved components.

Basically, it is possible that an unlocking is carried out by operating a separate triggering button. According to a preferred embodiment, however, the locking device can be unlocked by over-pressing the movable furniture part into an over-pressed position behind the closed position by bringing the rotary axis and the line of action in a relative unlocking state where the rotary axis and the line of action are distanced from each other. As soon as the line of action no longer runs through the rotary axis, the force of the ejection force storage member eccentrically engages the ejection element, whereby the ejection element starts to rotate. In particular, a triggering device is provided which can abut the ejection element, wherein in the event of over-pressing the ejection element can be rotated by the triggering device, whereby the line of action and the rotary axis are reaching the relative unlocking state. Subsequently, the ejection element can be rotated by the ejection force storage member about the rotary axis starting from the relative unlocking state so that the ejection element ejects—preferably indirectly via a tensioning element—the movable furniture part in the opening direction. For the unlocking, it is particularly preferred that in the locking position, the triggering device on the one hand abuts the ejection element and on the other hand abuts the movable furniture part. Basically, it is absolutely possible that the ejection element itself directly abuts the movable furniture part. Preferably, however, at least one intermediate portion is provided, namely in the form of a tensioning element (or other translation mechanisms). The ejection element, thus, is that element which is directly actuated by the ejection force storage member and which is locked in the locking position.

In principle, it is possible that the ejection force storage member is formed as a leg spring. In this case, the leg spring has to be arranged in the ejection device in such a way that in the locking position, the line of action of this leg spring runs through the rotary axis. In order to guarantee the locking in a simple manner, preferably the ejection device comprises a carrier, wherein the ejection force storage member on the one hand engages the carrier via a carrier force storage member base and on the other hand engages the ejection element via an ejection element force storage member base. In the locking position, the carrier force storage member base and the ejection element force storage member base are located in a plane comprising the rotary axis of the ejection element and the line of action. Thereby, in the easiest manner to verify, it can be guaranteed that a secure locking position is provided when the carrier force storage member base, the ejection element force storage member base and the rotary axis in a top view are located substantially in one line.

Preferably, the ejection force storage member is formed as a tension spring or as a compression spring. If the ejection force storage member is formed as a tension spring, in the locking position the rotary axis is arranged exactly between the ejection element force storage member base and the carrier force storage member base. If, in contrast, the ejection force storage member is formed as a compression spring, in the locking position the ejection element force storage member base is arranged exactly between the rotary axis and the carrier force storage member base. Overall, thus, the carrier (in particular its carrier force storage member base), the ejection force storage member and the ejection element (in particular its ejection element force storage member base) form the locking device.

An item of furniture includes a furniture carcass, a movable furniture part, and the ejection device according to the invention for the movable furniture part. In this case, the ejection device can either be arranged on the furniture carcass or on the movable furniture part. It is also possible that a, preferably damped, retraction device for retracting the movable furniture part from an open position into the closed position is additionally provided.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1:
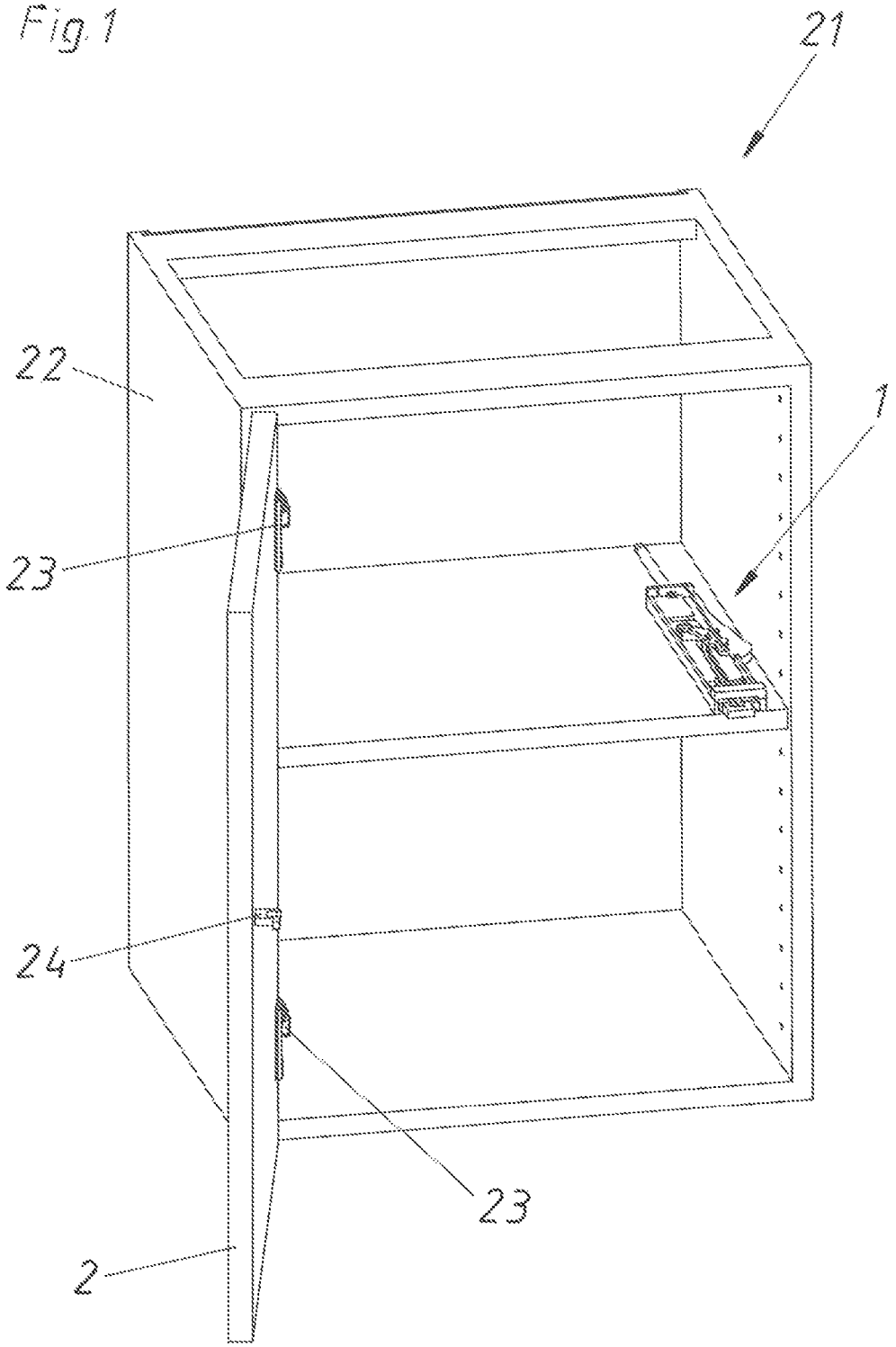
FIG. 1 shows an item of furniture with an ejection device according to a first embodiment.

FIG. 1 shows an item of furniture 21 with a furniture carcass 22 and a movable furniture part 2 in form of a furniture door. This movable furniture part 2 is pivotally supported by two hinges 23 on the furniture carcass 22 about a vertical axis. A damping device (not shown) for a closing movement can be integrated in at least one of the hinges 23. An ejection device 1 according to a first embodiment is arranged on the furniture carcass 22. The coupling counter piece 24 of this ejection device 1 is fixed to the movable furniture part 2. Only for the purpose of illustration this coupling counter piece 24 is also directly drawn in the area of the ejection device 1. Of course only the coupling counter piece 24 on the movable furniture part 2 is actually present. Basically, it is possible with all embodiments that the ejection device 1 is arranged on the movable furniture part and the coupling counter piece 24 is arranged or formed on the furniture carcass 22. As a consequence, the ejection device 1 so to speak pushes itself from the furniture carcass 22.

Figure 2:
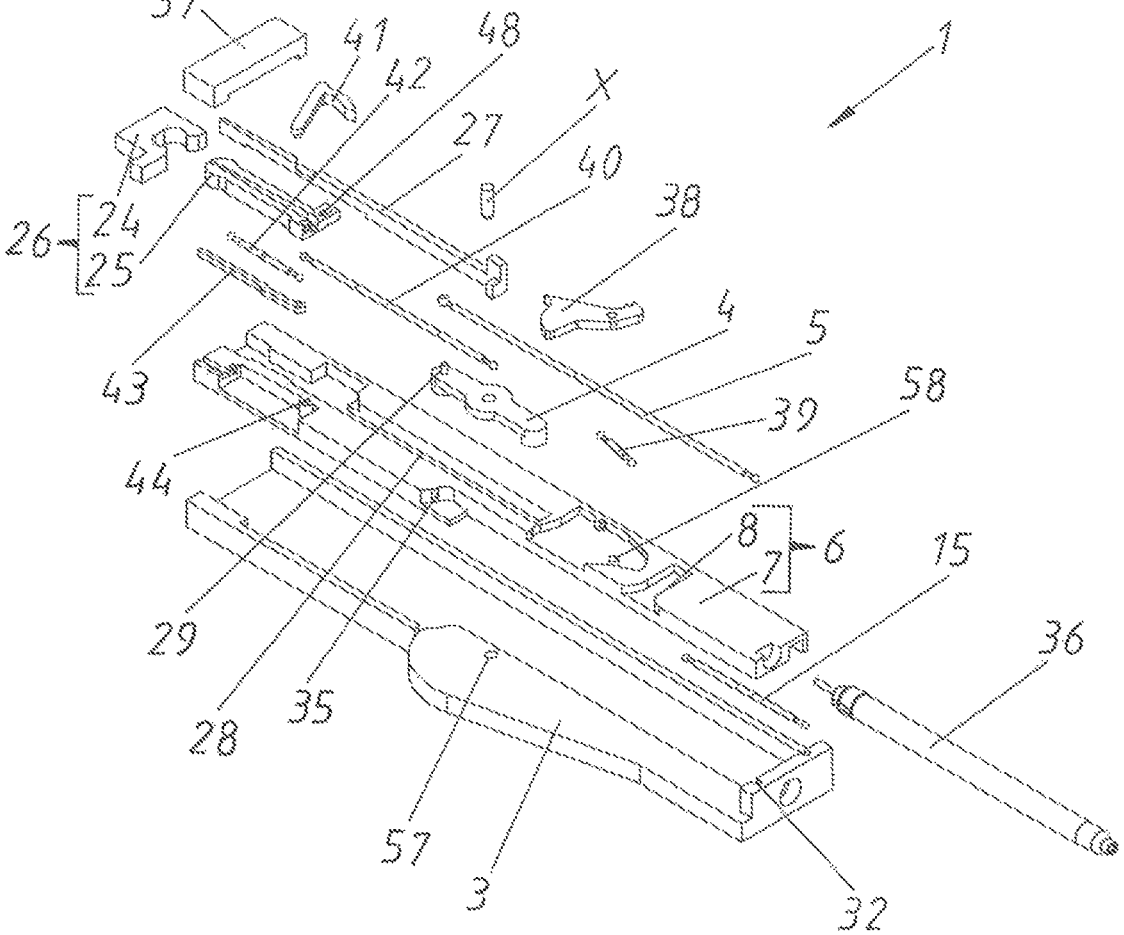
FIG. 2 is an exploded view of the ejection device according to the first embodiment.

In FIG. 2, the ejection device 1 according to the first embodiment is shown in an exploded view. This ejection device 1 comprises a carrier 3 as a base element by which the ejection device 1 is mounted to the item of furniture 21. This carrier 3 together with a cover (not shown) can form a housing for the remaining components of the ejection device 1. The tensioning element 7 is displaceably supported in the carrier 3. The displacing movement of this tensioning element 7 is being damped by the damping device 36. The retrieving force storage member 15 on the one hand engages the tensioning element 7 and on the other hand the carrier 3. The tensioning element 7 together with the movement transmission element 8 formed as an abutment are forming the tensioning device 6. Further, an ejection element 4 is rotatably supported about the rotary axis X in the rotary bearing 57 of the carrier 3. The ejection force storage member 5 formed as a tension spring on the one hand engages the ejection element 4 via the ejection element force storage member base 29 and on the other hand engages the carrier force storage base 32 of the carrier 3. The deflection element 38 is pivotally supported on the tensioning element 7 via the rotary bearing pin 58. A deflection force storage member 39 formed as a tension spring is additionally provided between the deflection element 38 and the tensioning element 7. Further, a coupling device 26 is provided. This coupling device 26 is mainly formed by the coupling piece 25 and the coupling counter piece 26. The coupling piece 25 is displaceably supported in the guide track 28 of the tensioning element 7. Also the coupling and decoupling element 27 is displaceably arranged in this guide track 28. Moreover, a coupling lever 41 is provided which is rotatably supported in the rotary bearing 44 of the tensioning element 7 and which on the one hand is guided in the elongated hole of the coupling piece 25 and on the other hand is hingedly connected to an end of the coupling counter piece abutment 43. Further, a coupling force storage member 40 formed as a tension spring is provided which on the one hand engages the coupling and decoupling element 27 and on the other hand engages the coupling piece 25. Moreover, a coupling lever force storage member 42 also formed as a tension spring is provided. This coupling lever force storage member 42 on the one hand engages the coupling lever 41 and on the other hand engages the tensioning element 7. Further, a head portion 37 is provided which can be connected to the carrier 3.

Figure 3:
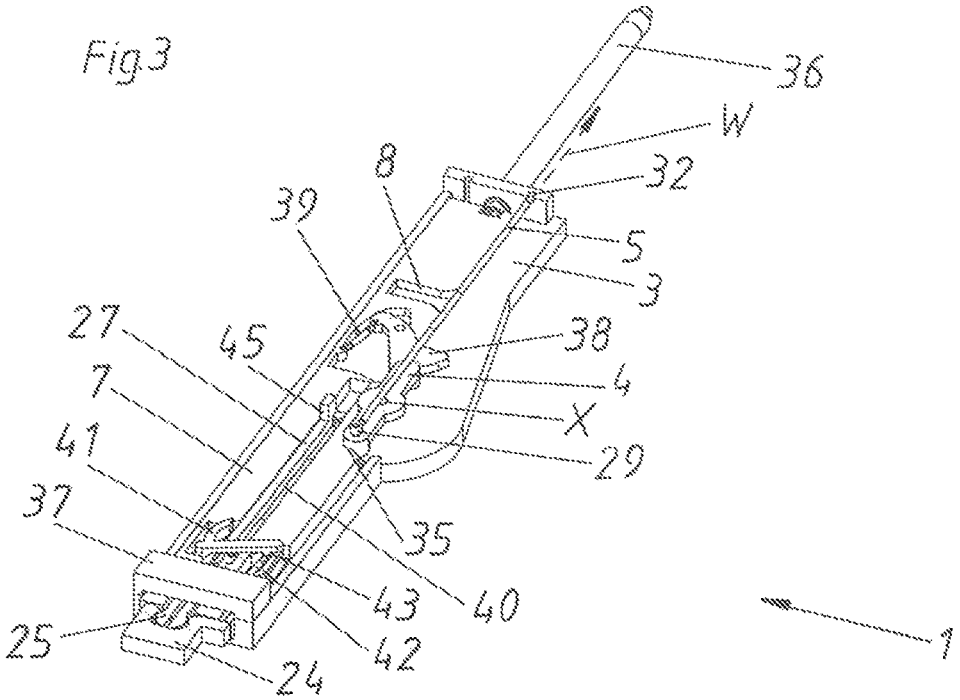
FIG. 3 shows this ejection device in an assembled state.

FIG. 3 shows the ejection device 1 according to the first embodiment in an assembled state. Already in this illustration according to FIG. 3, it can be recognized well that the carrier force storage member base 32 and the ejection element force storage member base 29 are located in a plane comprising the rotary axis X of the ejection element 4 and the line of action W. Further, the abutment 45 formed on the coupling and decoupling element 27 is also visible. It can also be recognized in this FIG. 3 that the ejection element 4 abuts the triggering device 35 formed as an abutment on the tensioning element 7.

Figure 4:
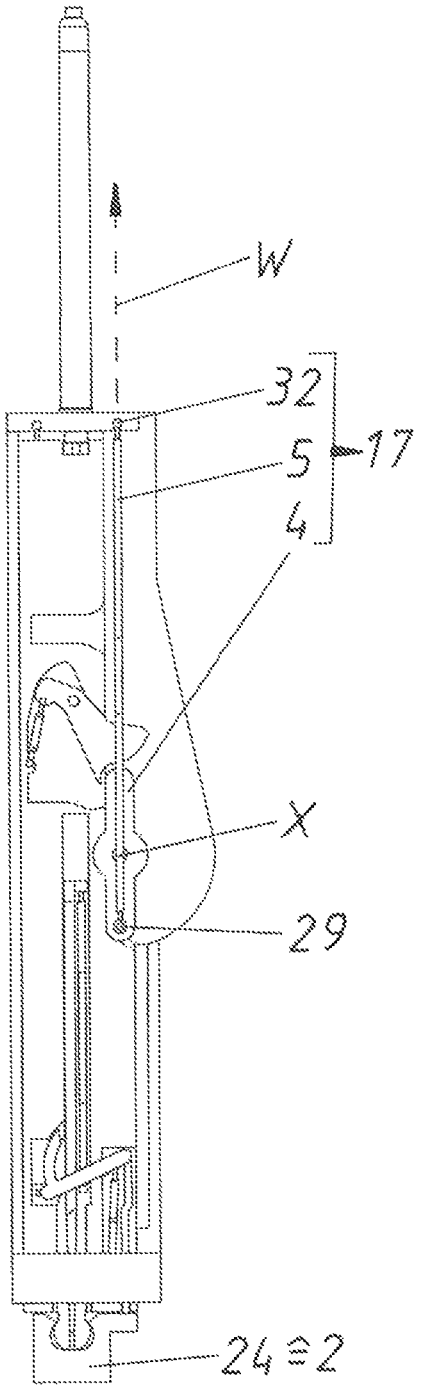
FIGS. 4 to 20 show the movement sequence during the ejection and tensioning of the ejection device according to the first embodiment.

FIG. 4 shows a top view of the ejection device 1 according to FIG. 3. The coupling counter piece 24 attached to the movable furniture part 2 represents the position of the movable furniture part 2. Accordingly, the movable furniture part is located in a closed position SS. The locking device 17 is situated in the locking position VS in which the line of action W of the ejection force storage member 5 is running through the rotary axis X. The direction of action of the line of action W is indicated by the arrow and points in closing direction SR. As this line of action W leads through the rotary axis X, the force of the tensioned ejection force storage member 5 cannot unfold. Therefore, the ejection element 4 is held so to speak in a dead center. The carrier force storage member base 32 (together with the carrier 3), the ejection force storage member 5 and the ejection element 4, thus, together form the locking device 17. The coupling device 26 is situated in the coupling position K as the coupling piece 25 is coupled to the coupling counter piece 24.

Figure 5:
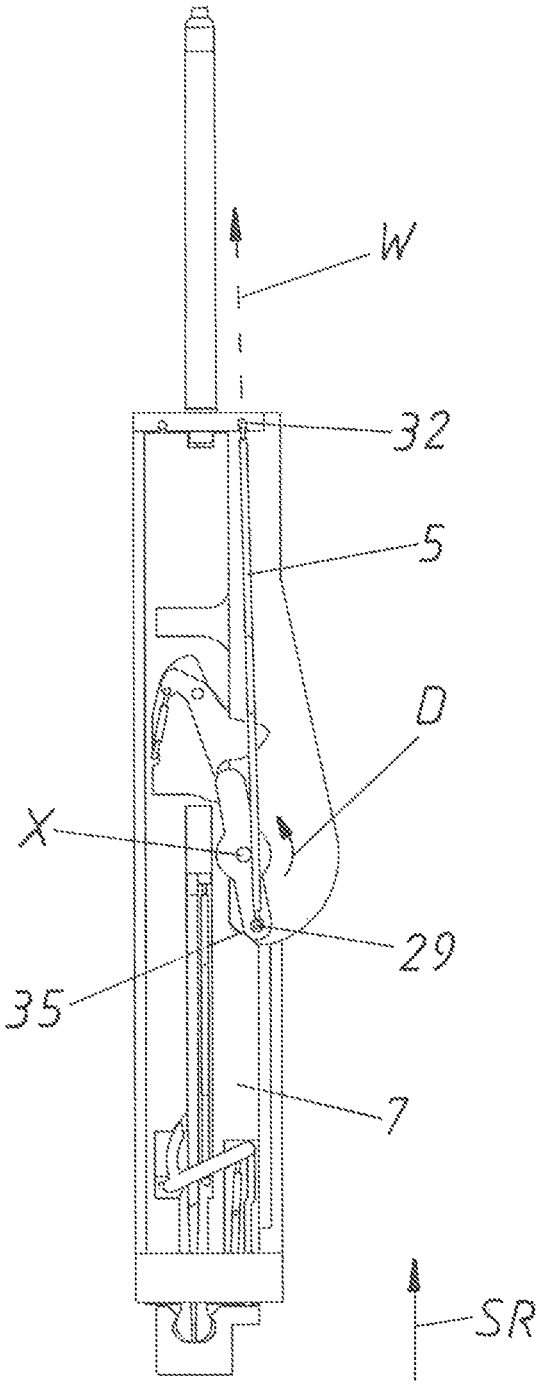

When the movable furniture part 2 is being pressed in closing direction SR starting from this position according to FIG. 4, this movable furniture part 2 reaches the over-pressed position US according to FIG. 5. As a consequence, the tensioning element 7 is also moved in closing direction SR by the coupling counter piece 24, whereby the abutment of the triggering device 35 rotates the ejection element 4 in the rotary direction D—thus counterclockwise—about the rotary axis X (the tensioning element 7 and the triggering device 35 collectively forming a triggering element). As a consequence of this over-pressing, the rotary axis X and the line of action W, thus, are distanced from each other and reach a relative unlocking state ES. Hence, the locking device 17 is unlocked.

Figure 6:
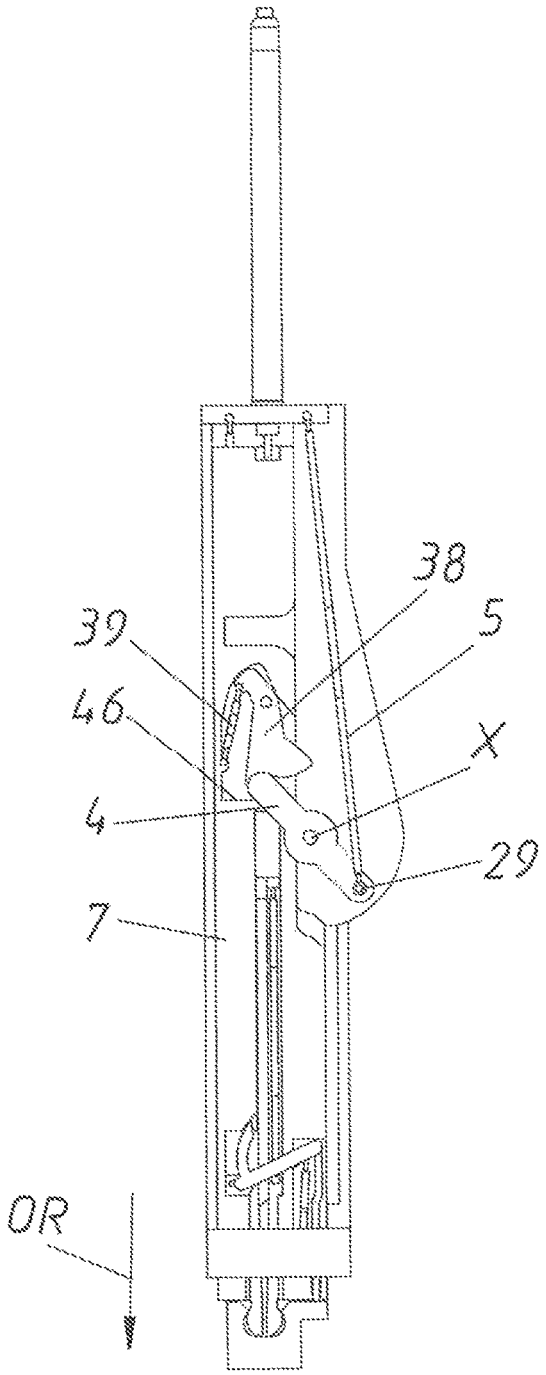

The ejection force storage member 5 can relax starting from this unlocking state ES according to FIG. 5, whereby the ejection element 4 further rotates in rotary direction D (see FIG. 6). As a consequence, the end of the ejection element 4 remote from the ejection element force storage member base 29 reaches contact with the ejection abutment 46 formed on the tensioning element 7. This causes the whole tensioning element 7 to be moved in the opening direction OR relative to the carrier 3, whereby the movable furniture part 2 in turn reaches an—albeit still marginal—open position OS. At the same time the ejection element 4 also pivots the deflection element 38 clockwise against the force of the deflection force storage member 39.

Figure 7:
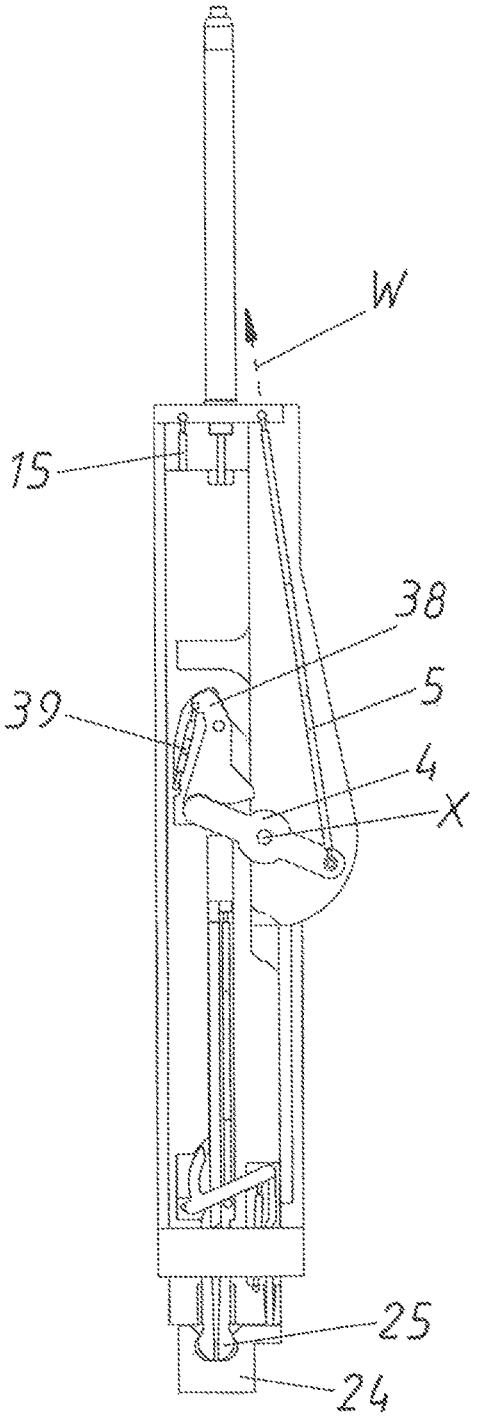

The ejection force storage member 5 has still further relaxed in FIG. 7, whereby the movable furniture part 2 (represented by the coupling counter piece 24) is being moved still further into an open position OS. Thus, the movable furniture part 2 is indirectly being ejected by the ejection element 4 via the tensioning element 7 and the coupling piece 25. As the tensioning element 7 is moved in the opening direction OR, the retrieving force storage member 15 formed as a tension spring starts to tension.

Figure 8:
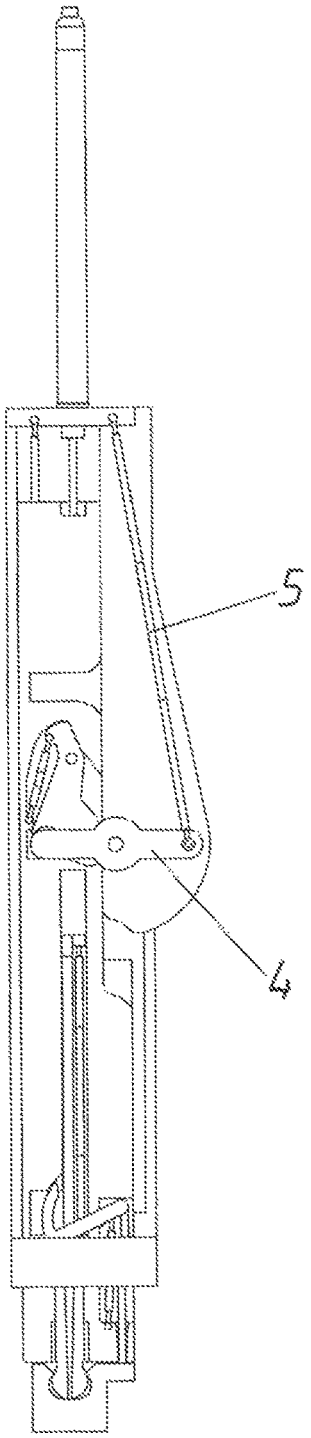

In FIG. 8, a quarter turn of the ejection element 4 is completed. The ejection force storage member 5 has already relaxed substantially halfway. The movable furniture part 2 is located in an open position OS, the locking device 17 is in the unlocking state ES and the coupling device 26 is the coupling position K. The deflection force storage member 39 is fully tensioned.

Figure 9:
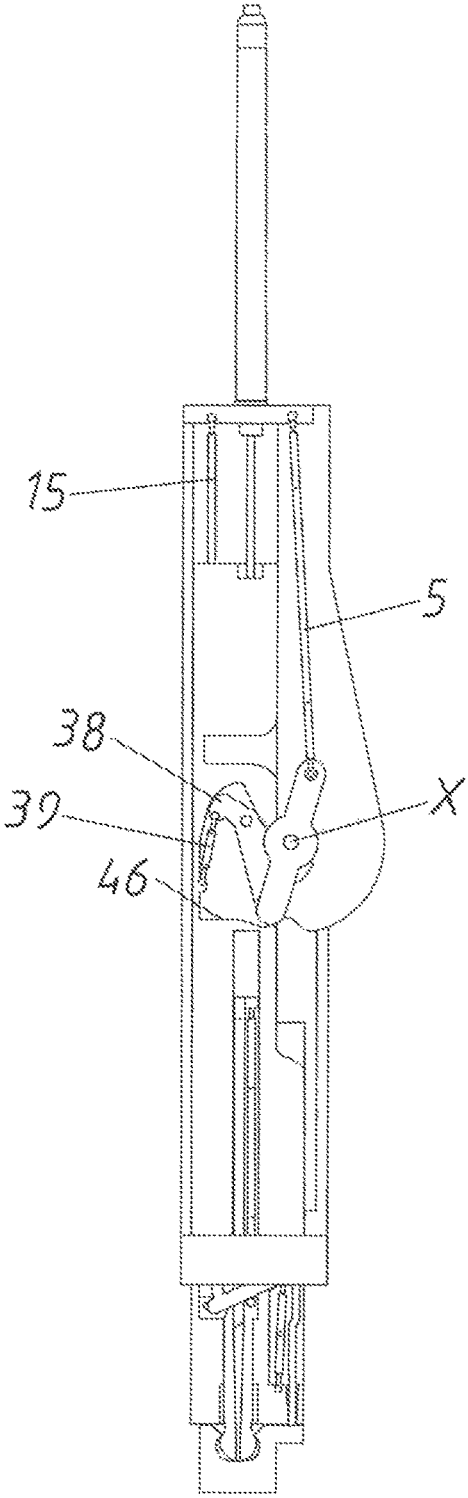

As the ejection element 4 has already moved further according to FIG. 9, the end of the ejection element 4 remote from the ejection element force storage member base 29 is also again being oppositely moved (i. e., in this case to the right). As a consequence, the deflection force storage member 39 is also again being relaxed, whereby the deflection element 38 follows the ejection element 4.

Figure 10:
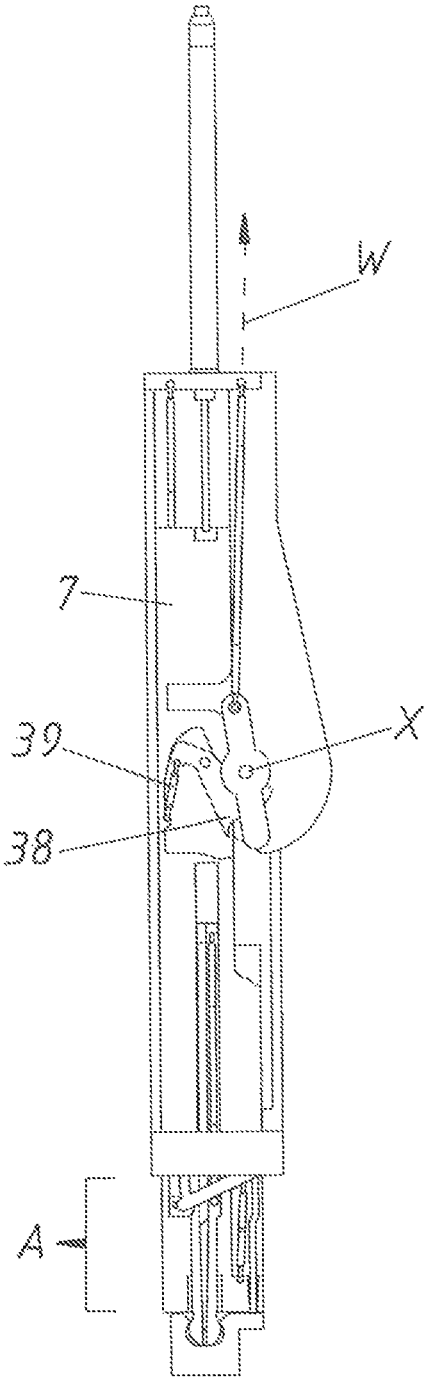
Figure 11:
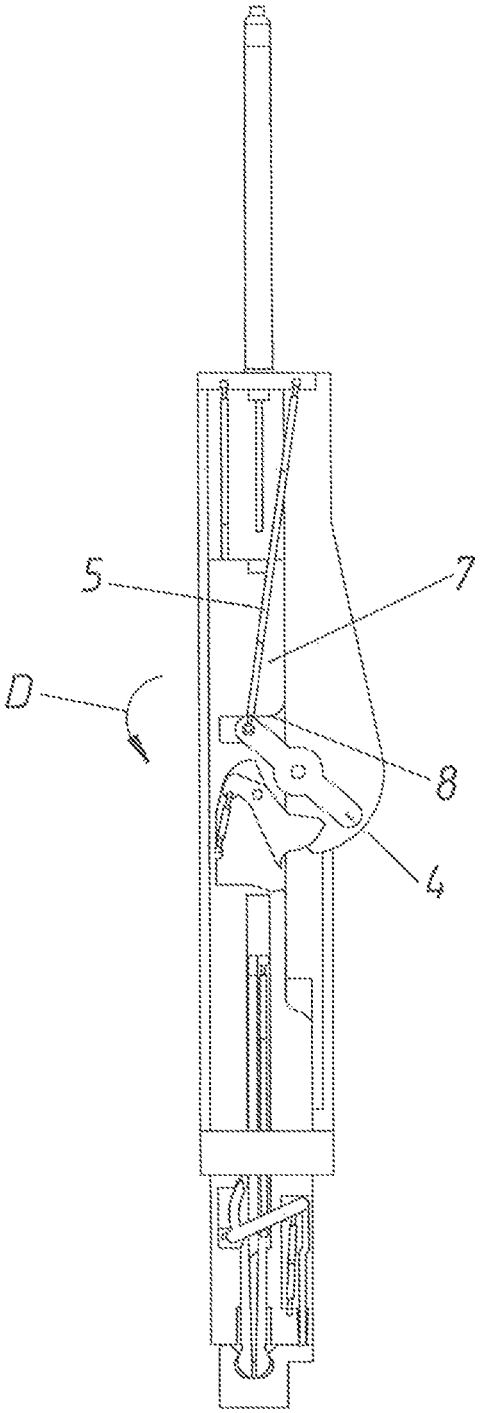

The ejection device 1 reaches a position (not shown) between the FIGS. 9 and 10, in which a dead center opposite from the locking position VS is reached. In this position, in a top view, the carrier force storage member base 32, the ejection element force storage member base 29 and the rotary axis X are arranged in one line. The deflection force storage member 39, however, is further relaxing in order to still further move the ejection element 4 starting from this neutral state or dead center state, whereby the deflection element 38 moves the ejection element 4 into the position according to FIG. 10. In this position, the ejection path A of the ejection device 1 is completed. Starting with this position, thus, the tensioning path S begins, in which the movable furniture part 2 is actively being pulled. As the tensioning element 7 is coupled to the movable furniture part 2 by the coupling device 26, according to FIG. 11, the ejection element 4 is also moved in the opening direction OR by the movement transmission element 8 formed as an abutment. As a consequence, when tensioning the ejection force storage member 5, the ejection element 4 is rotated in the same rotary direction D (counterclockwise) as when ejecting the movable furniture part 2.

Figure 12:
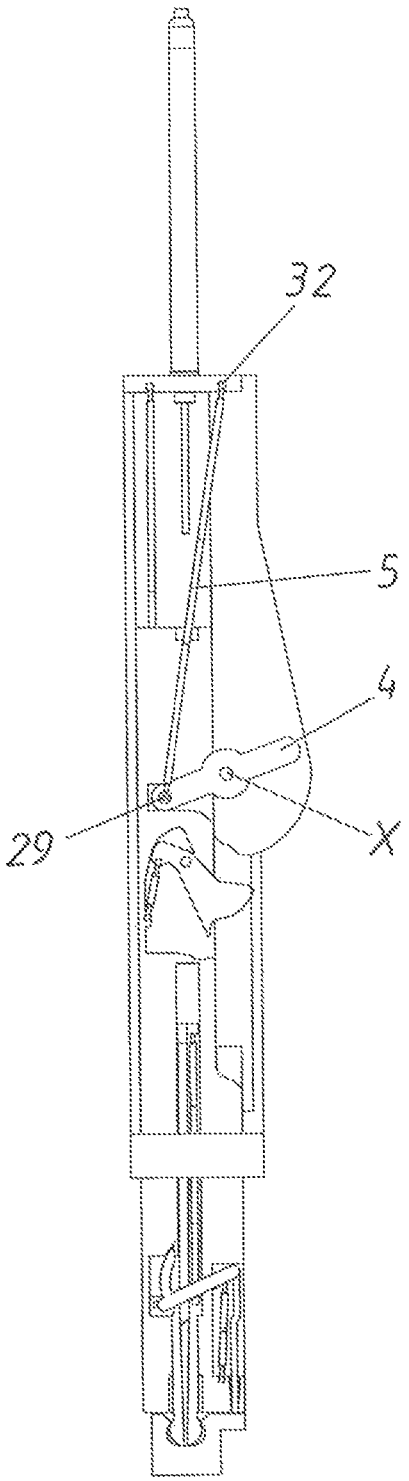

According to FIG. 12, the ejection element 4 has still further rotated in the rotary direction D about the rotary axis X by the movement transmission element 8.

Figure 13:
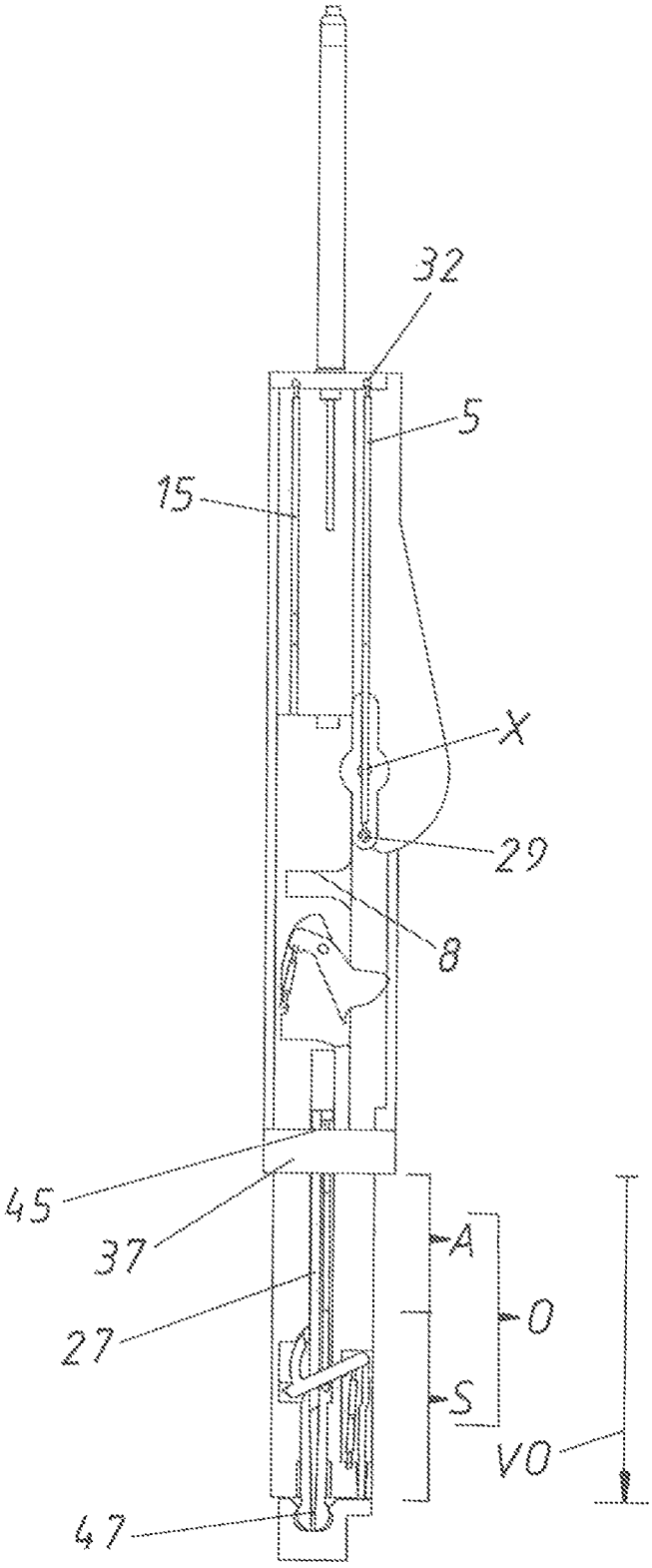

In FIG. 13, the tension path S of the tensioning device 6 is finally completed. Hence, the ejection device 1 has moved along the opening path O (consists of the ejection path A and the tensioning path S) in the opening direction OR. At the same time, the ejection element 4 has also carried out a full revolution, whereby the locking position VS is reached again, in which the line of action W of the ejection force storage member 5 is running through the rotary axis 5. The retrieving force storage member 15 is fully loaded. The abutment 45 on the coupling and decoupling element 27 abuts the head portion 37, whereby the predetermined opening path VO for the control device formed by the coupling and decoupling element 27 for the coupling device 26 is reached or traveled. The tip 47 of the coupling and decoupling element 27 is still located in the foremost region of the coupling piece 25, whereby the head region of the coupling piece 25 is still spread or whereby the two projections of the head region, which are distanced from each other by a gap, cannot be bent to each other. The coupling position K between the head region of the coupling piece 25 and the receiving region of the coupling counter piece 24 is provided by a positive-locking engagement.

Figure 14:
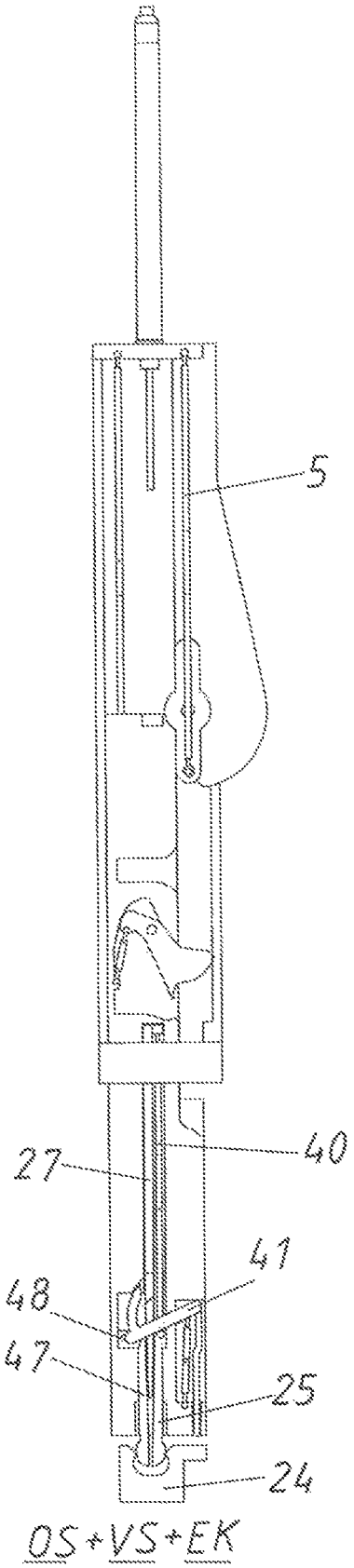

When further pulling the movable furniture part 2 starting from this position according to FIG. 13, a travel-controlled uncoupling of the coupling device 26 takes place (see FIG. 14). Initially, the tensioning element 7 is further being moved in the opening direction OR by means of the coupling piece 25. As the coupling and decoupling element 27 forming the control device, however, abuts the head portion 37, only the coupling piece 25 together with the tensioning element 7 moves relative to the carrier 3 in the opening direction OR. As a consequence, the tip 47 of the coupling and decoupling device 27 is removed from the head region of the coupling piece 25, whereby this head region is less strong or no longer spread. Thus, the projections of the head region can bend to each other. Thereby, the decoupling position EK is reached and there is only a loose connection between the head region of the coupling piece 25 and the receiving region of the coupling counter piece 24. Thus, the no longer spread coupling piece 25 can already be released from the coupling counter piece 24 according to FIG. 14. During the relative movement of the coupling and decoupling element 27 to the coupling piece 25, the coupling force storage member 40 is also tensioned as this coupling force storage member 40 on the one hand engages the coupling piece 25 and on the other hand engages the coupling and decoupling element 27.

The movable furniture part 2 is freewheeling as soon as the coupling counter piece 24 is completely released from the coupling piece 25. At the same time, the coupling force storage member 40 can again relax, whereby the coupling piece 25 is moved relative to the tensioning element 7 in the closing direction SR. As a consequence, the coupling lever 41 is also pivoted about the rotary bearing 44. With this movement also the coupling counter piece abutment 43 is being moved beyond the tensioning element 7 while the coupling lever force storage member 42 is relaxing. When the coupling piece 25 is moved back, the head region of the coupling piece 25 arrives between the side walls of the coupling piece guide 49, whereby the parts of the head region of the coupling piece 25 distanced from each other are pressed towards each other. As a consequence, the tip 47 of the coupling and decoupling element 27 cannot move all the way forward into the coupling piece 25. The coupling force storage member 40, thus, cannot be fully tensioned, but only about halfway.

Figure 16:
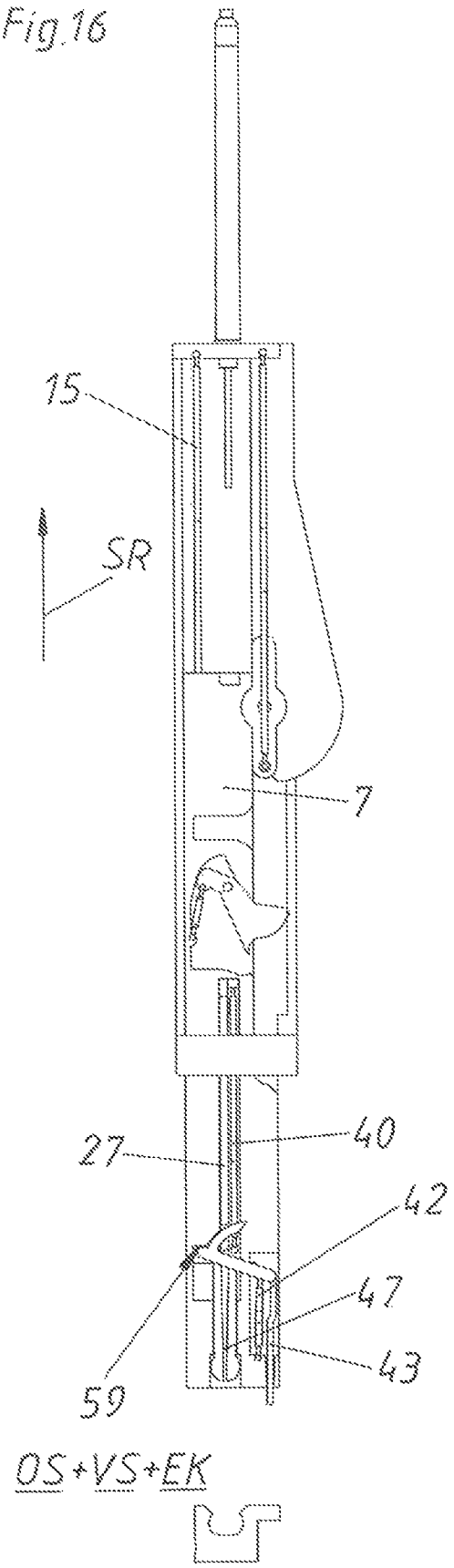

However, in order to still move the coupling piece 25 all the way into the coupling piece guide 49, the coupling lever force storage member 42 relaxes according to FIG. 16 and pivots the coupling lever 41 till the coupling piece 25 abuts the abutment 59 of the tensioning element 7. As a consequence, the coupling counter piece abutment 43 is also fully extended. The tip 47 of the coupling and decoupling element 27 is not yet completely in the foremost region of the coupling piece 25.

Figure 15:
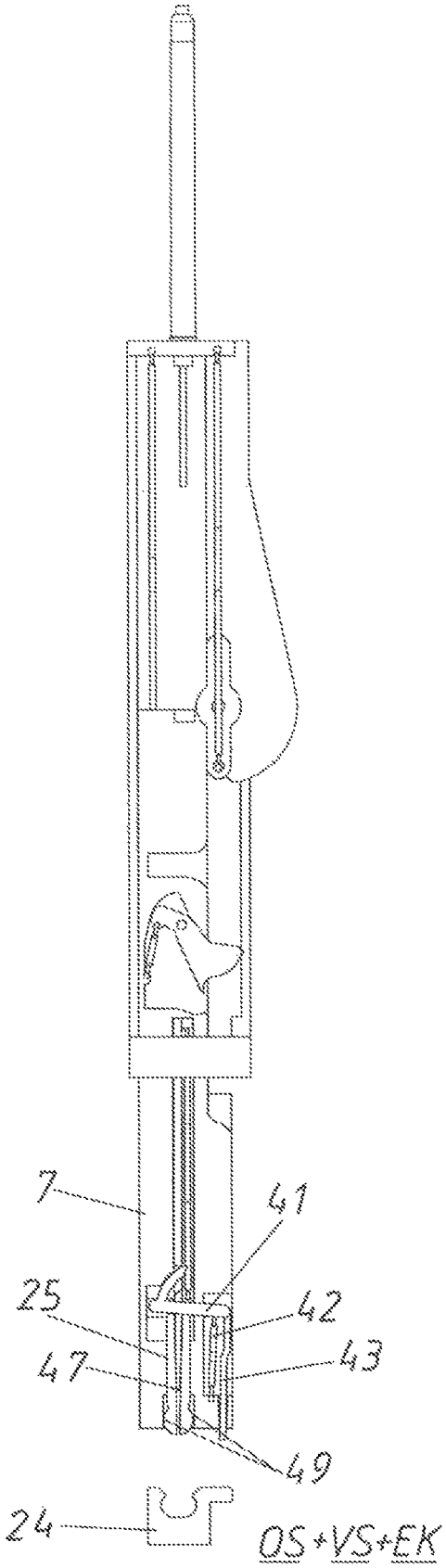
Figure 17:
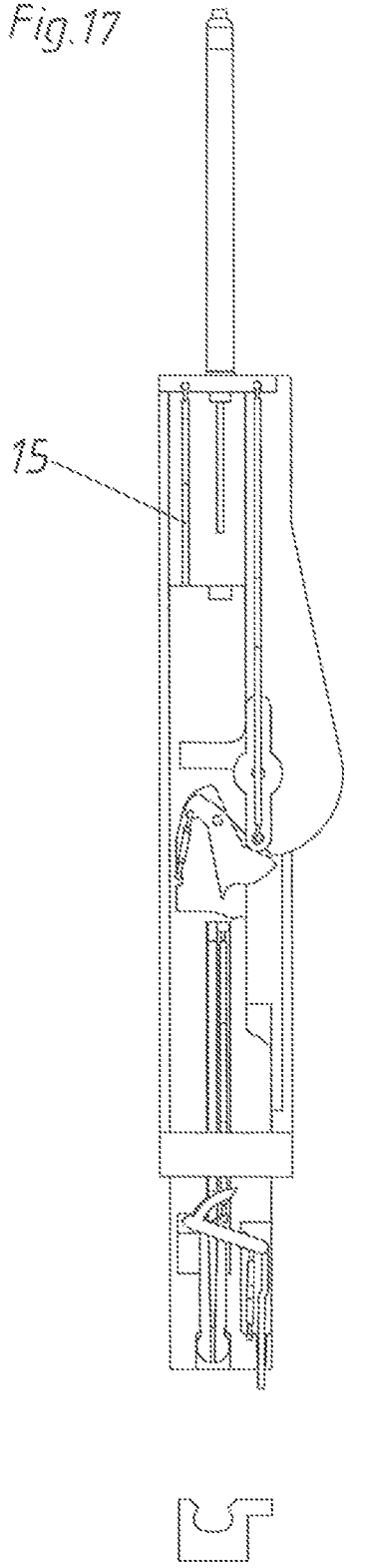

Starting from FIG. 16, respectively already starting from FIG. 15, the retrieving force storage member 15 begins to relax, whereby the position according to FIG. 17 is initially reached.

Figure 18:
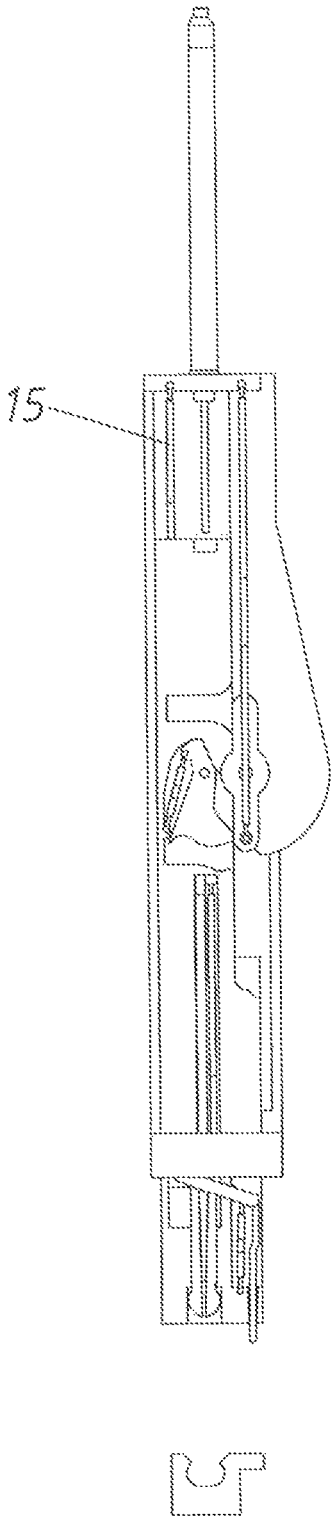
Figure 19:
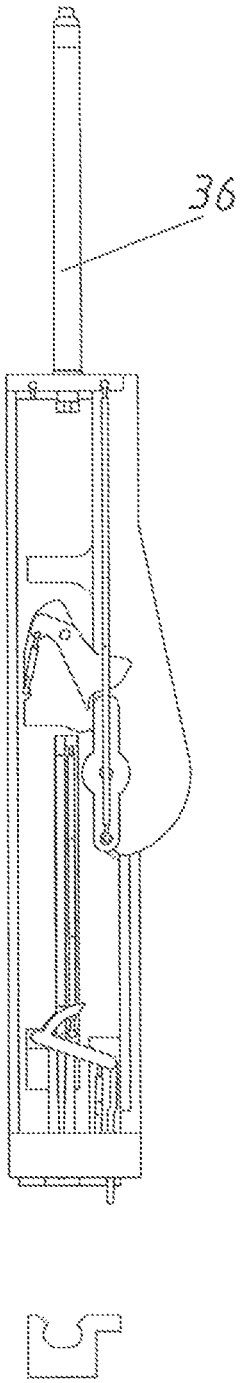

Subsequently, the tensioning element 7 is further moved back by the relaxing retrieving force storage member 15 until the position according to FIG. 18 is reached. Finally, the retrieved position R in FIG. 19 is reached. This retrieving movement from FIG. 18 to FIG. 19 is damped by the damping device 36. The movable furniture part 2 is still in an open position OS. The locking device 17 is in the locking position VS.

Figure 20:
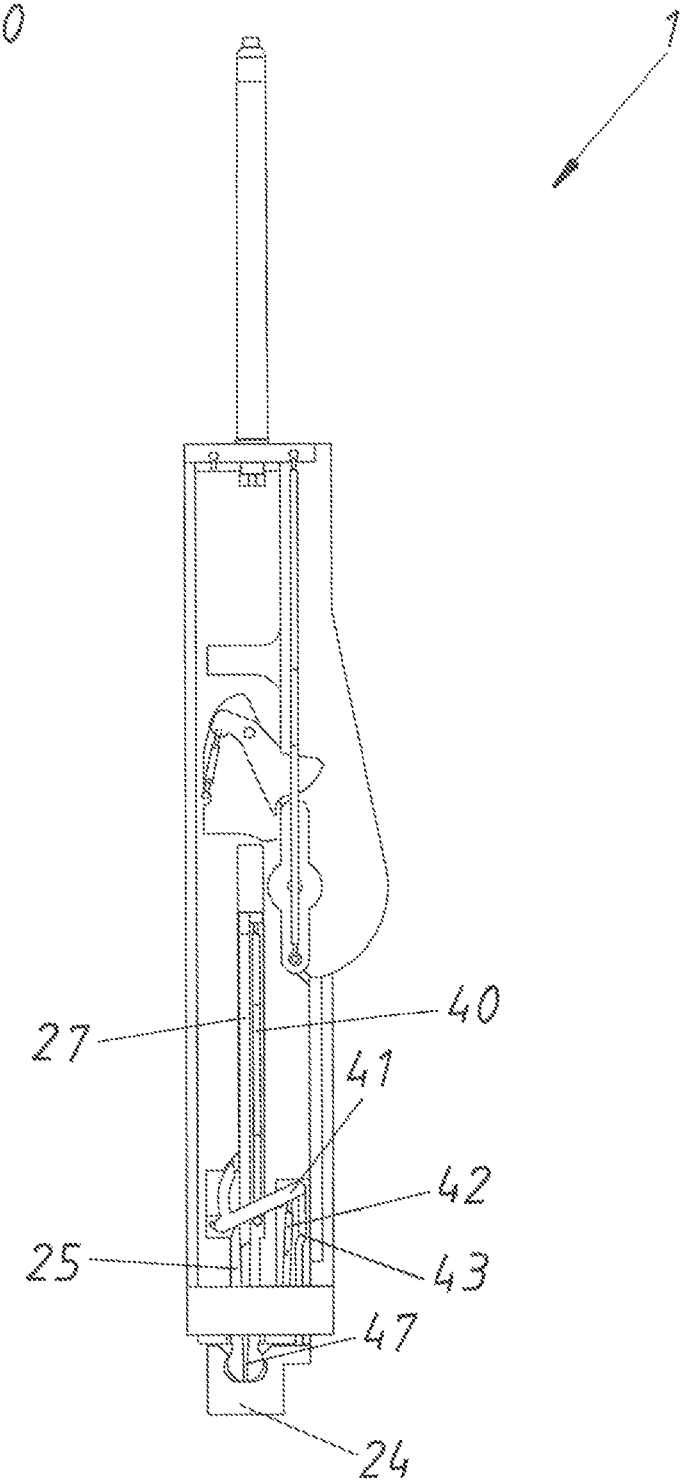

When finally also the movable furniture part 2 is being closed according to FIG. 20, the coupling counter piece 24 initially reaches contact with the coupling counter piece abutment 43. As a consequence, the coupling piece 25 is initially moved in the opening direction OR by the rotary movement of the coupling lever 41, whereby the initially non-spread head region of the coupling piece 25 engages the receiving region of the coupling counter piece 24. As then the coupling piece 25 is no longer held between the side surfaces of the coupling piece guide 49 in a narrowing manner, the coupling force storage member 40 has also relaxed according to FIG. 20, whereby the tip 47 of the coupling and decoupling element 27 has again fully penetrated the head region of the coupling piece 25 and, thus, has spread this head region. Hence, the coupling position K of the coupling device 26 is again reached in FIG. 20. This FIG. 20 corresponds again to the starting position according to FIG. 4.

Figure 21:
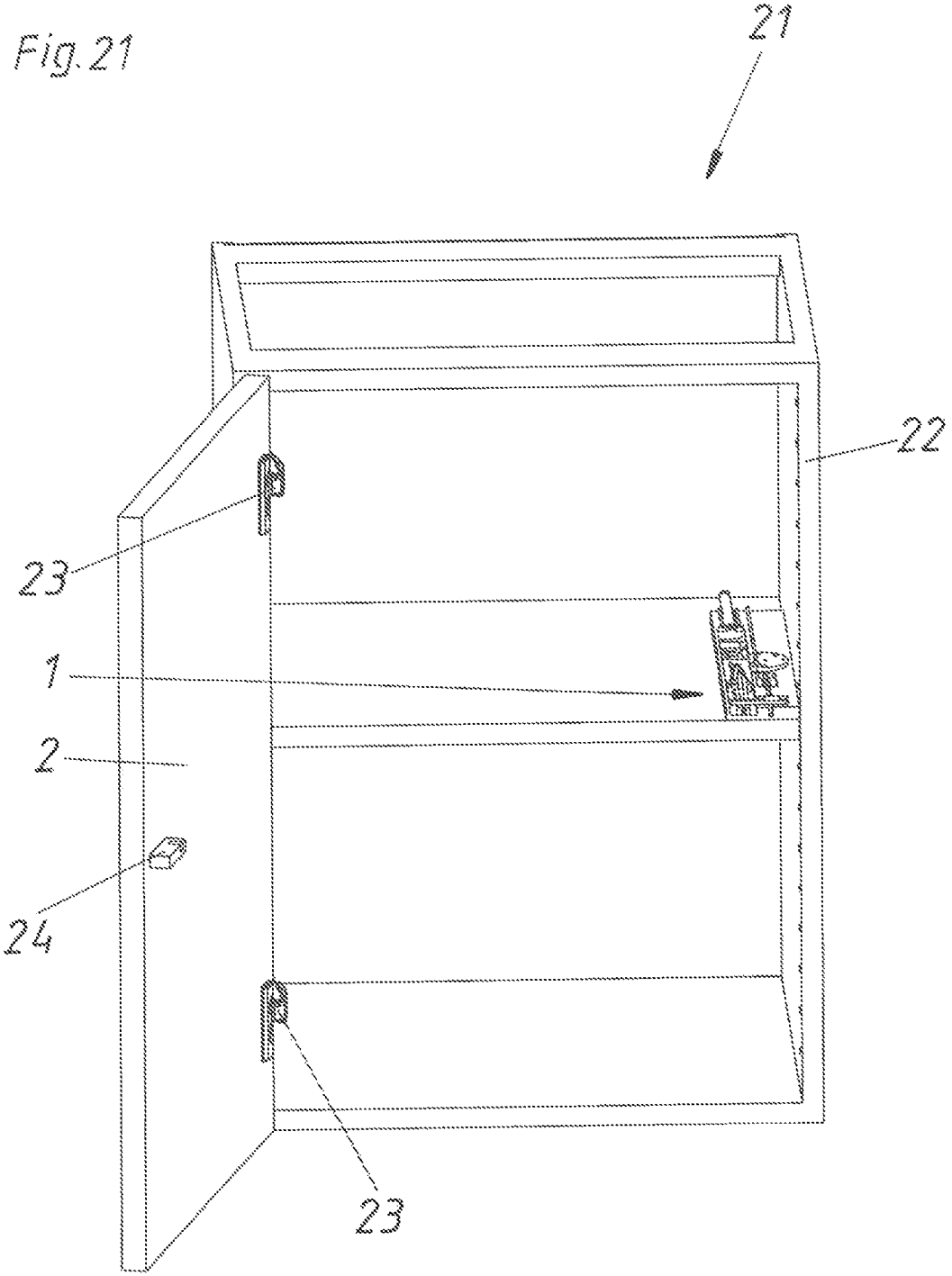
FIG. 21 shows an item of furniture with an ejection device according to a second embodiment.

FIG. 21 shows an item of furniture 21 comprising a furniture carcass 22 and a movable furniture part 2 with a second embodiment of an ejection device 1. Also in this case, the movable furniture part is again hingedly connected to the furniture carcass 22 by hinges 23. The coupling counter piece 24 of the ejection device 1 is mounted to the movable furniture part 2.

Figure 22:
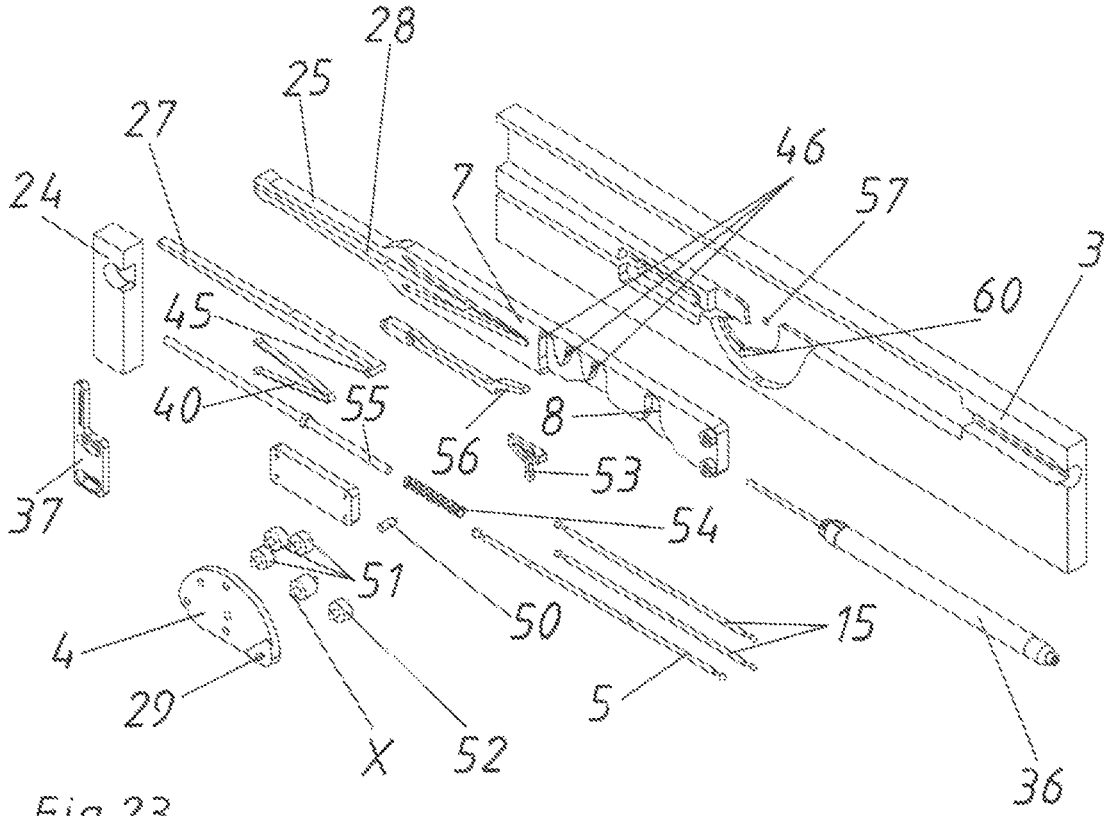
FIG. 22 is an explodes view of the ejection device according to the second embodiment.

The second embodiment of the ejection device 1 is shown in detail in the exploded view according to FIG. 22. Again, the ejection device 1 comprises a carrier 3 which forms—together with a cover (not shown)—a housing for the remaining components of the ejection device. The tensioning element 7 is displaceably supported in the carrier 3. This tensioning element 7 is movably supported on the carrier 3 in a damped manner by means of a damping device 36. The tensioning element 7 is connected to the carrier 3 by a retrieving force storage member 15. A guide track 28 for the coupling and decoupling element 27 is provided in the tensioning element 7. This coupling and decoupling element 27 is prestressed to the left against the tensioning element 7 by means of a coupling force storage member 40. In this case, the coupling force storage member 40 is formed as a V-formed tension spring, wherein the tension spring is held with its ends in the tensioning element 7 and abuts the coupling and decoupling element 27 in a central region. Further, a coupling element tensioner 56 connected to the carrier 3 is provided, the coupling element tensioner 56 can abut the abutment 45 of the coupling and decoupling element 27. Moreover, also in the embodiment a head portion 37 is mounted to the carrier 3. In total three ejection abutments 46 are provided in the tensioning element 7, the ejection abutments 46 correspond to the ejection rollers 51 arranged on the ejection element 4. The ejection element 4 itself is rotatably supported in the rotary bearing 57 of the carrier 3 about the rotary axis X. In addition, a tensioning roller 52 is arranged on the ejection element 4. An eccentric pin 50 is eccentrically arranged on the ejection element 4. The ejection force storage member 5 is connected on the one hand to the ejection element 4 by means of the ejection element force storage member base 29 and is connected on the other hand to the carrier 3 by means of the carrier force storage member base 32. Further, also a triggering device 35 is provided. In this embodiment the triggering device 35 is formed by the triggering element 55, the triggering spring 54 and the triggering bracket 53. This triggering bracket 53 is held in the recess 60 of the carrier 3.

Figure 23:
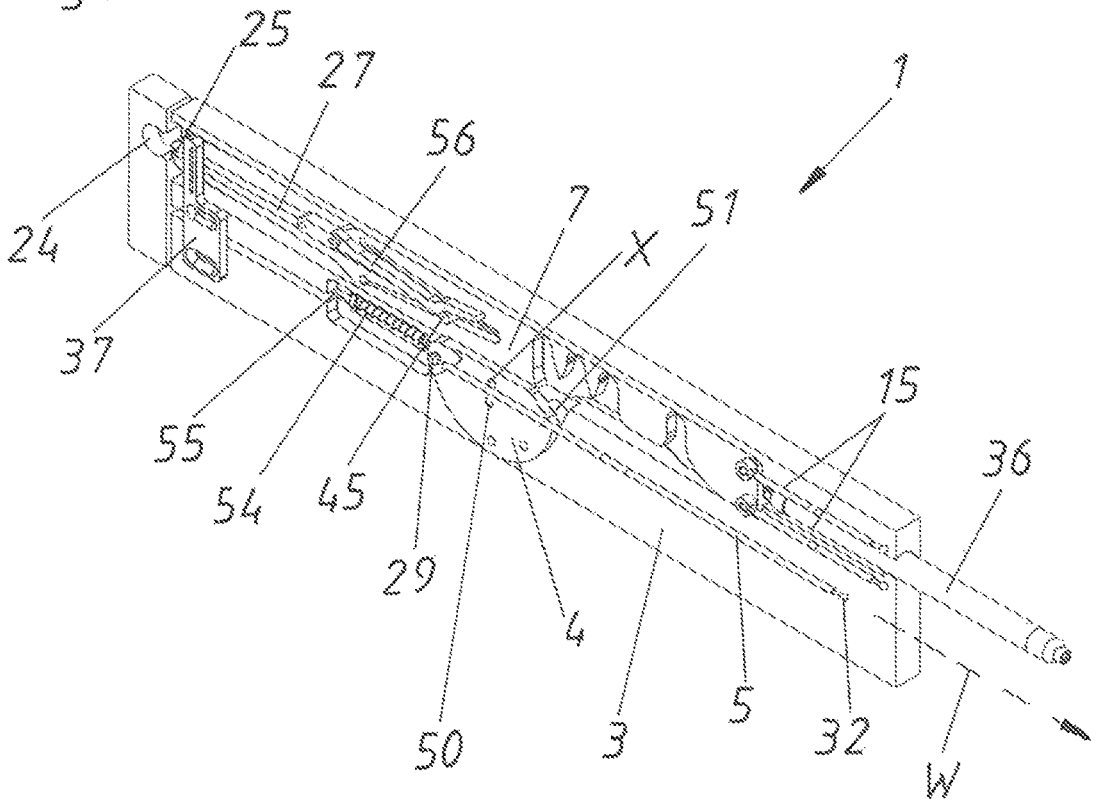
FIG. 23 shows the ejection device in an assembled state and FIGS. 24 to 37 show the movement sequence of the ejection device according to the second embodiment.

In FIG. 23 the second embodiment of the ejection device 1 is shown in an assembled state. Here, the abutment 45 of the coupling and decoupling element 27 abuts the coupling element tensioner 56. Moreover, it can be seen that in the shown locking position VS the carrier force storage member base 32 and the ejection element force storage member base 29 are located in a plane comprising the rotary axis X of the ejection element 4 and the line of action W.

Figure 24:
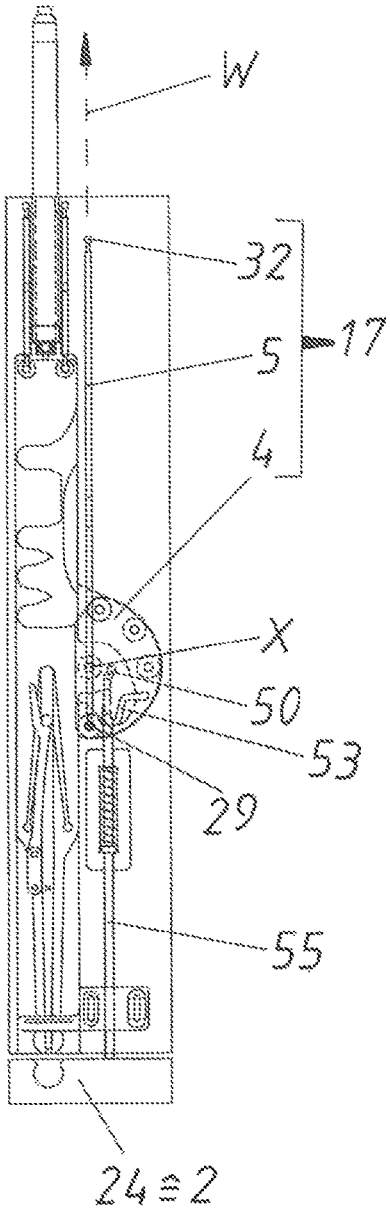

FIG. 24 shows a top view of the ejection device 1 corresponding to FIG. 23. The position of the coupling counter piece 24 corresponds to the position of the movable furniture part 2 which is located in the closed position SS. In addition, the locking device 17 is in the locking position VS as the line of action W of the ejection force storage member 5 is running through the rotary axis X. The triggering bracket 53 abuts with its front side the eccentric pin 50. The knee region of the triggering bracket 53, in turn, abuts the end region of the triggering element 55. The other end of this triggering element 55 abuts the coupling counter piece 24. The head region of the coupling piece 25 is indeed spread by the tip 47 of the coupling and decoupling element 27, as the head region of the coupling piece 25, however, is not located in the receiving region of the coupling counter piece 24, the coupling device 26 is still in a decoupling position EK.

Figure 25:
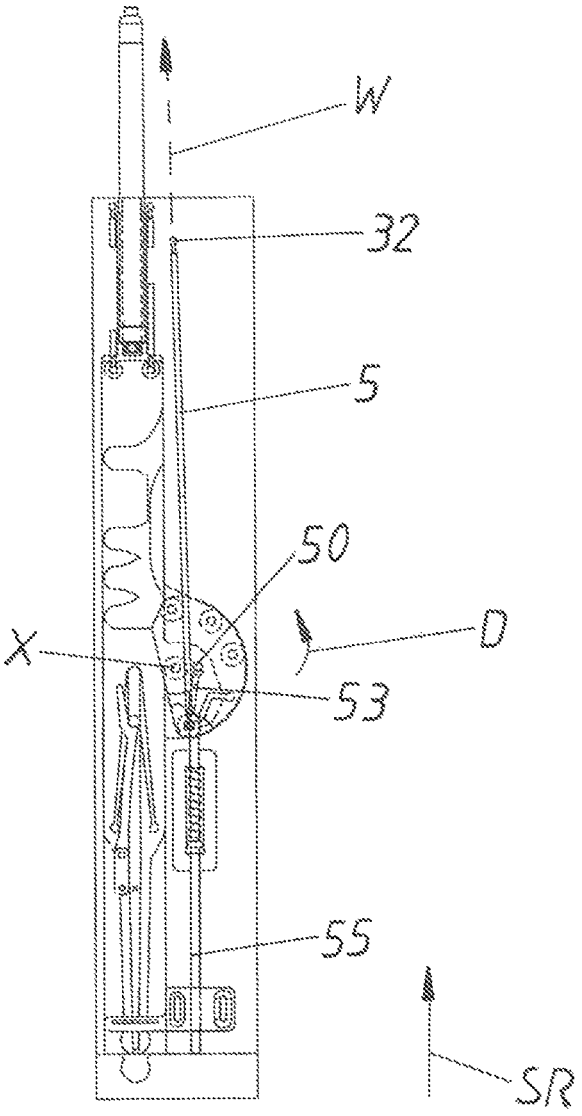

If now pressing in the closing direction SR onto the movable furniture part 2 starting from this closed position SS according to FIG. 24, the movable furniture part 2 arrives in the over-pressed position US according to FIG. 25. As the triggering element 55 abuts the coupling counter piece 24 and as the flexible triggering bracket 53, in turn, abuts the triggering element 55 by means of its knee region, the front side of the triggering bracket 53 is being pressed onto the eccentric pin 50, whereby the ejection element 4 is being rotated in the rotary direction D about the rotary axis X. As a consequence, the rotary axis X and the line of action W arrive in a relative unlocking state ES where the rotary axis X and the line of action W are distanced from each other. Thus, the locking device 17 is unlocked. (In the shown embodiment the ejection element force storage member base 29 is always moved for the unlocking. In principle, however, it would also be possible that, when over-pressing, the rotary axis X is shifted in such a way that the rotary axis X is distanced from the line of action W. Thereby, the line of action W would remain unchanged in relation to the carrier 3, the rotary axis X, however, would move relative to the carrier 3.)

Figure 26:
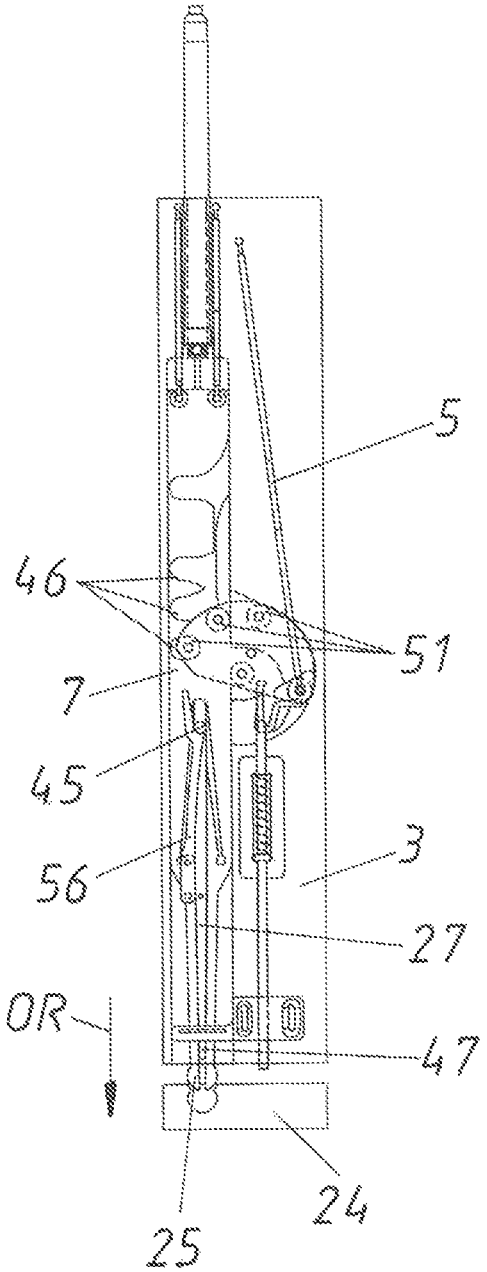

As soon as a user of the item of furniture 21 is no longer pressing onto the movable furniture part 2, the ejection force storage member 5 starts to further relax according to FIG. 26. This ejection force storage member 5 moves the ejection element 4 and rotates the ejection element 4 counterclockwise further in the rotary direction D. As a consequence, the first of the three ejection rollers 51 reaches contact with the first of the three ejection abutments 46, whereby the tensioning element 7 is moved by the ejection element 4 in the opening direction OR. As the coupling piece 25 is integrally formed with the tensioning element 7, the coupling counter piece 24 and the movable furniture part 2 (together with the coupling counter piece 24) are moved in the opening direction OR by the head region of the coupling piece 25. Thereby, the movable furniture part 2 is in a—albeit still marginal opened—open position OS. The locking device 17 is in an unlocking state ES. The coupling device 26 is still in a decoupling position EK. According to FIG. 26, the tensioning element 7 has already been slightly moved in the opening direction OR relative to the carrier 3. However, as the coupling element tensioner 56 is attached to the carrier and as the abutment 45 abuts this coupling element tensioner 56, the coupling and decoupling element 27 forming the control device does not move together with the tensioning element 7 in the opening direction OR. As a consequence, the tip 47 of the coupling and decoupling device 27 is removed from the head region of the coupling piece 25. Thus, the head region of the coupling piece 25 is already less spread.

Figure 27:
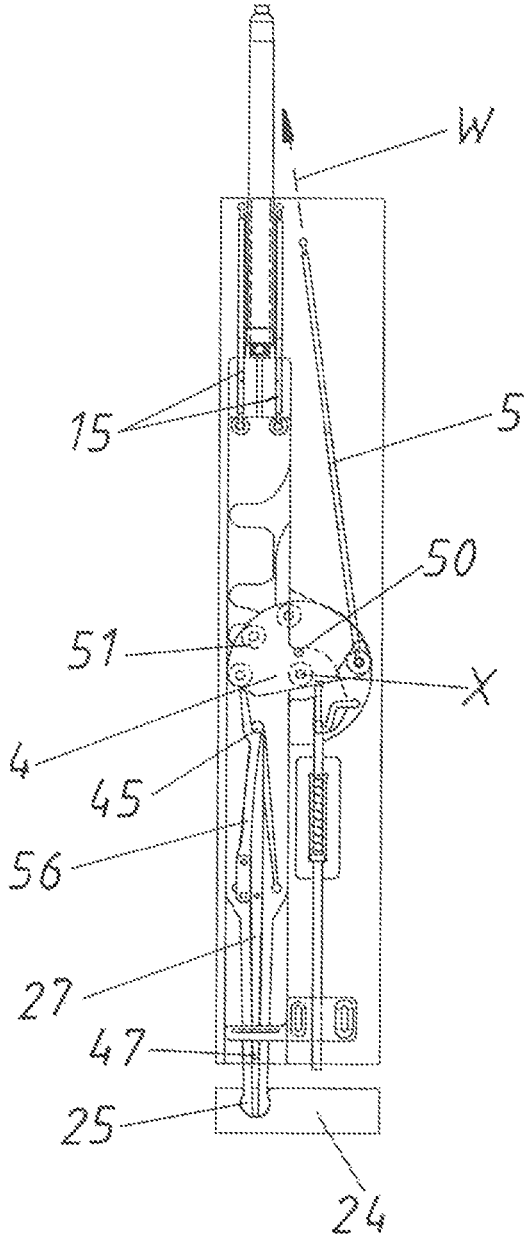

As according to FIG. 27, the tip 47 is still further moved back relative to the coupling piece 25, the head region of the coupling piece 25 is no longer spread, and this head region can slide into the receiving region of the coupling counter piece 24 because of the bendable design of its two projections. As a consequence, however, only a loose connection between the coupling piece 25 and coupling counter piece 24 is reached. The coupling force storage member 40 is tensioned according to FIG. 27 by the movement of the coupling and decoupling element 27 along the guide track 28 relative to the tensioning element 7. According to FIG. 27 also the ejection element 4 has already rotated further, whereby a second ejection roller 41 reaches contact with a second ejection abutment 46.

Figure 28:
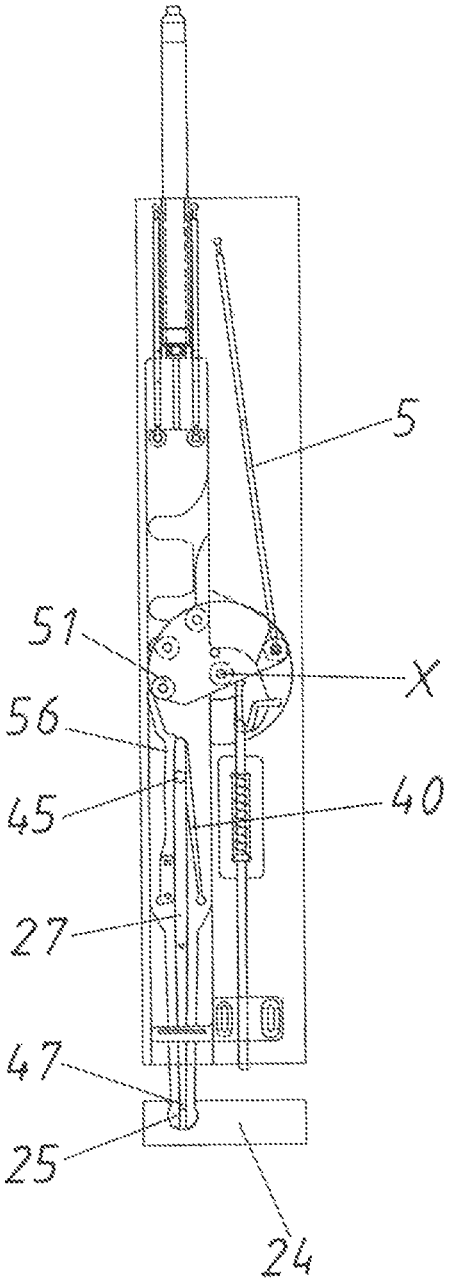

In the case of a further rotation of the ejection element 4 according to FIG. 28, an end of the elastic coupling element tensioner 56 reaches contact with the ejection element 4, whereby the coupling element tensioner 56 is slightly bent to the left. As a consequence, the abutment 45 of the coupling and decoupling element 27 is no longer held by the coupling element tensioner 45, whereby the coupling force storage member 40 can relax. Thereby, also the coupling and decoupling element 27 is again moved relative to the tensioning element 7 in the opening direction OR, whereby the tip 47 of the coupling and decoupling element 27 arrives in the head region of the coupling piece 25 and spreads this coupling piece 25. As a consequence, a safe positive-locking engagement and, thus, the coupling position K between the coupling piece 25 and the coupling counter piece 24 is reached. This coupling position K cannot be released without a movement of the coupling and decoupling device 27 relative to the coupling piece 25.

Figure 29:
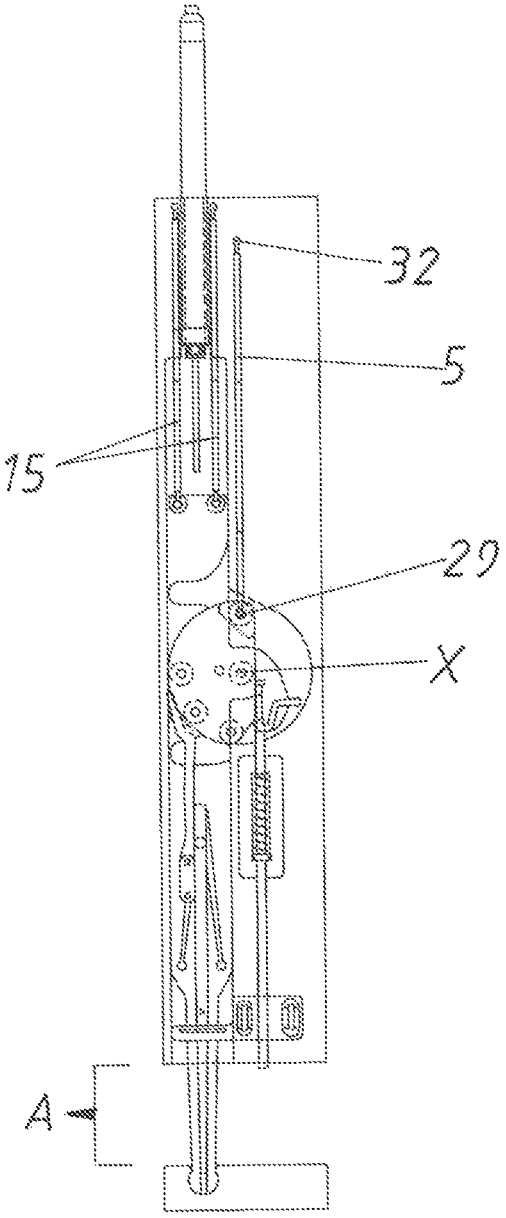

A half turn of the ejection element 4 is finished according to FIG. 29. Hence, the ejection force storage member 5 has completely relaxed and the ejection element 7 is again located in a neutral position. For this reason, the ejection path A of the ejection device 1 is finalized. The retrieving force storage members 15 have already relaxed about halfway. Starting from this FIG. 29 the movable furniture part 2 is now being pulled in the opening direction OR.

Figure 30:
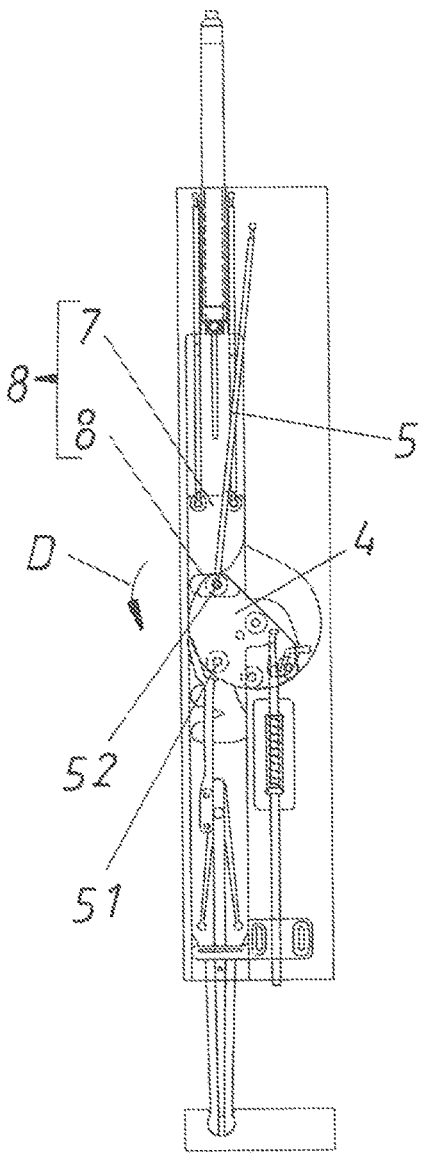

By this further pulling movement, which has already begun in FIG. 30, the tensioning element 7 is being moved further in the opening direction OR relative to the carrier 3. As a third ejection roller 51 is still in contact with the third ejection abutment 46, the ejection element 4—when tensioning the ejection force storage member 5—is further rotated in the same direction D as when ejecting the movable furniture part 2. At the same time, the tensioning roller 52 contacts the movement transmission element 8. The tensioning element 7 together with this movement transmission element 8 formed as an abutment are forming the tensioning device 6 for the ejection force storage member 5. This ejection force storage member 5 is already partly tensioned in FIG. 30.

Figure 31:
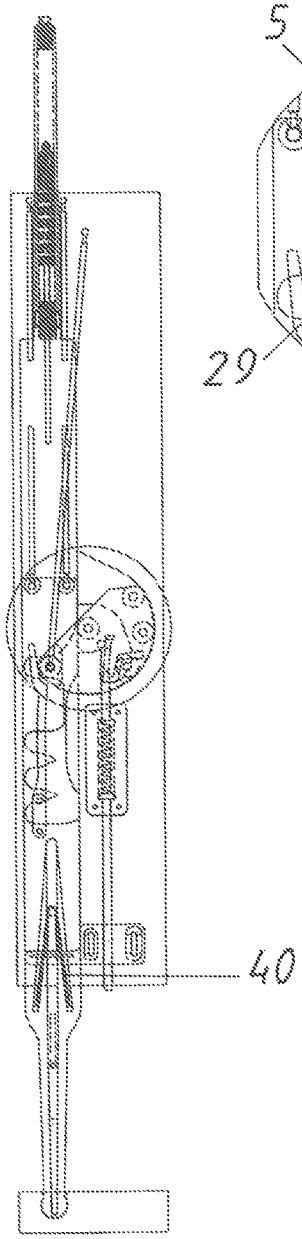
Figure 31:
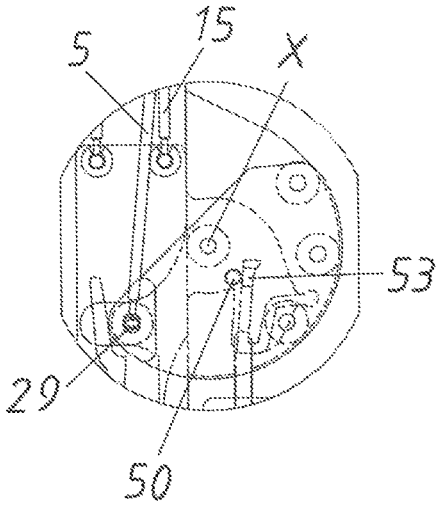

According to FIG. 31, the movable furniture part 2 has still been moved further in the opening direction OR and at the same time the ejection element 4 has been rotated further in the rotary direction D, whereby the eccentric pin 50 abuts a flank of the triggering bracket 53 and bends this triggering bracket 53 already slightly to the right because of its flexibility. This can be seen well in the detail shown top right.

Figure 32:
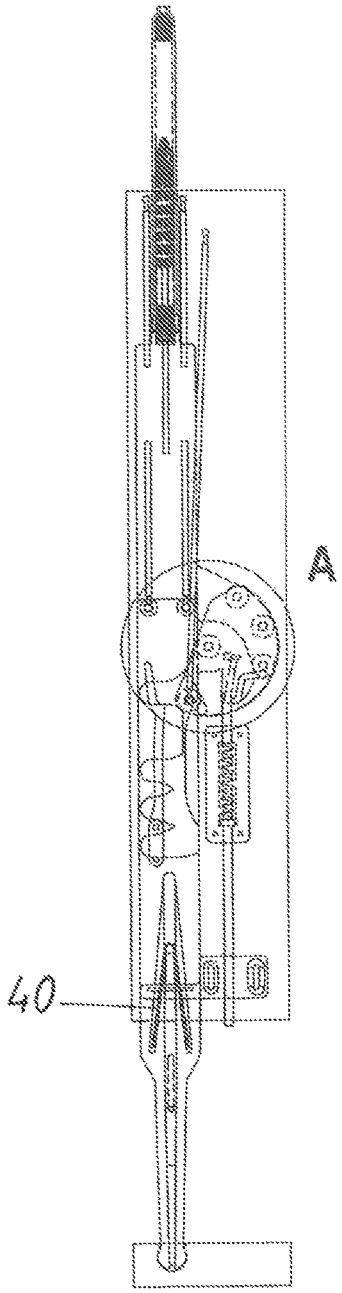

In FIG. 32 the movable furniture part 2 has still been moved further in the opening direction OR, whereby the ejection element 4 has rotated further. As a consequence, the eccentric pin 50 bends the triggering bracket 53 in a still more significant manner (see detail top right).

Figure 33:
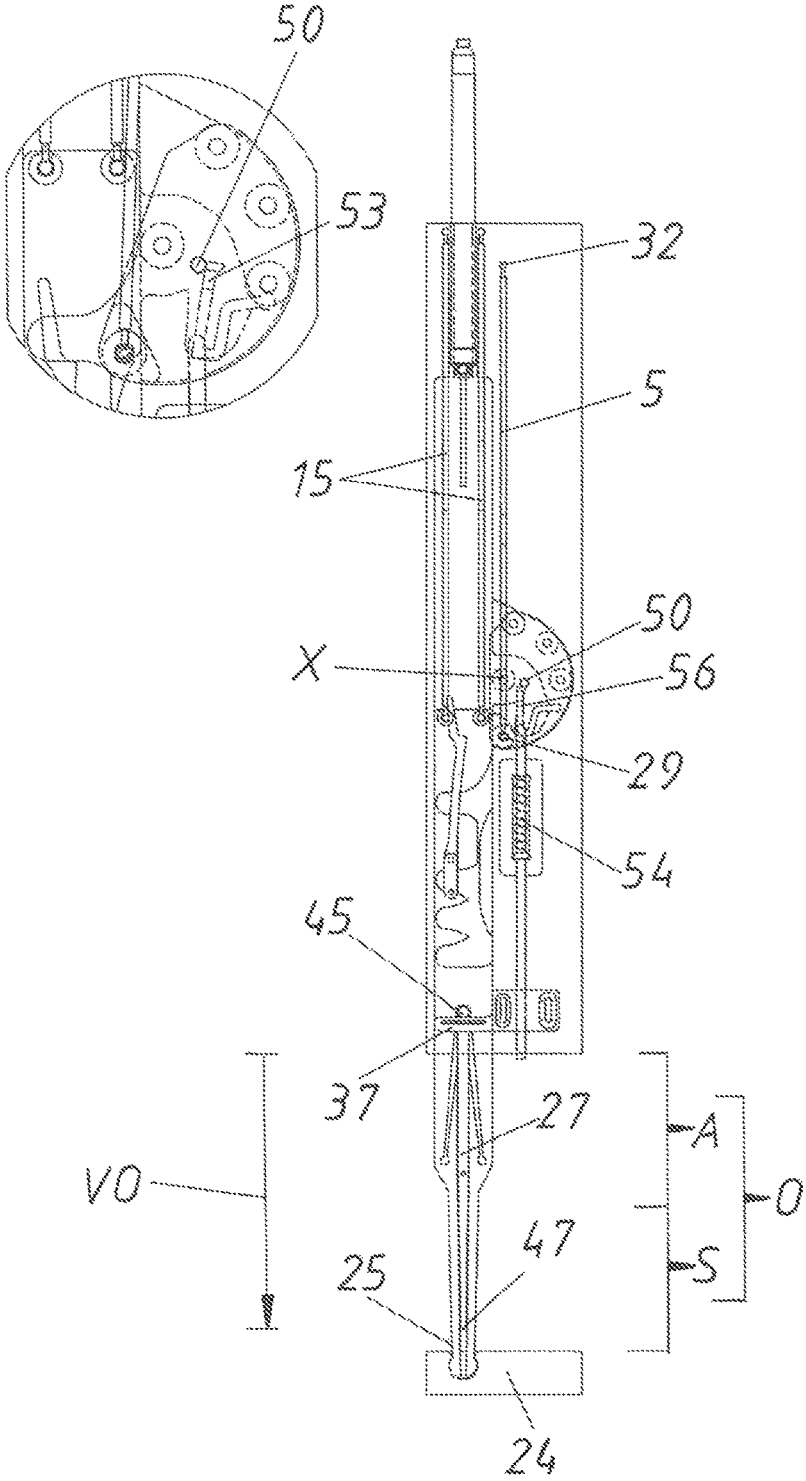
Figure 34:
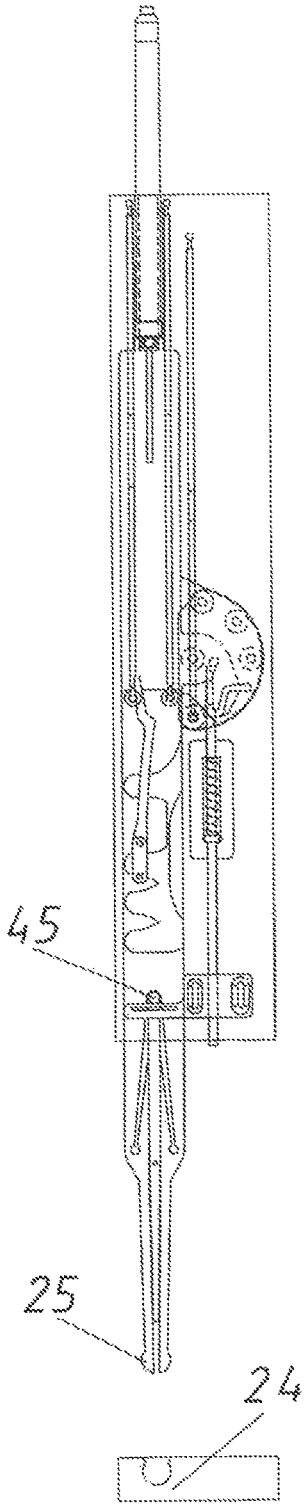

In the case of a further movement, the eccentric pin 50 finally passes the triggering bracket 53, whereby both components again arrive in their starting positions according to FIG. 33. The position of the triggering element 55 is again adapted by the triggering spring 54 in such a way that the triggering element 55 projects from the carrier by the gap size. According to FIG. 33, the tensioning path S is finalized. The tensioning path S together with the ejection path A results in the opening path O of the ejection device 1. During the movement of the ejection device 1 from FIG. 32 to FIG. 33, the abutment 45 of the coupling and decoupling element 27 reaches contact with the head portion 37. The predetermined opening path VO is reached. As a consequence, this coupling and decoupling element 27 is moved relative to the tensioning element 7 (at the same time the coupling force storage member 40 is being loaded), whereby the tip 47 of the coupling and decoupling element 27 is removed from the head region of the coupling piece 25 and the projections of this head region are no longer spread. Thus, the decoupling position EK of the coupling device 26 is reached. However, there is still a loose connection between the head region of the coupling piece 25 and the receiving region of the coupling counter piece 26.

If now further pulling on the movable furniture part 2 starting from this position according to FIG. 33, the coupling counter piece 24 can be released from the coupling piece 25 by bending the projections of the head region to each other and also the loose connection is repealed.

Figure 35:
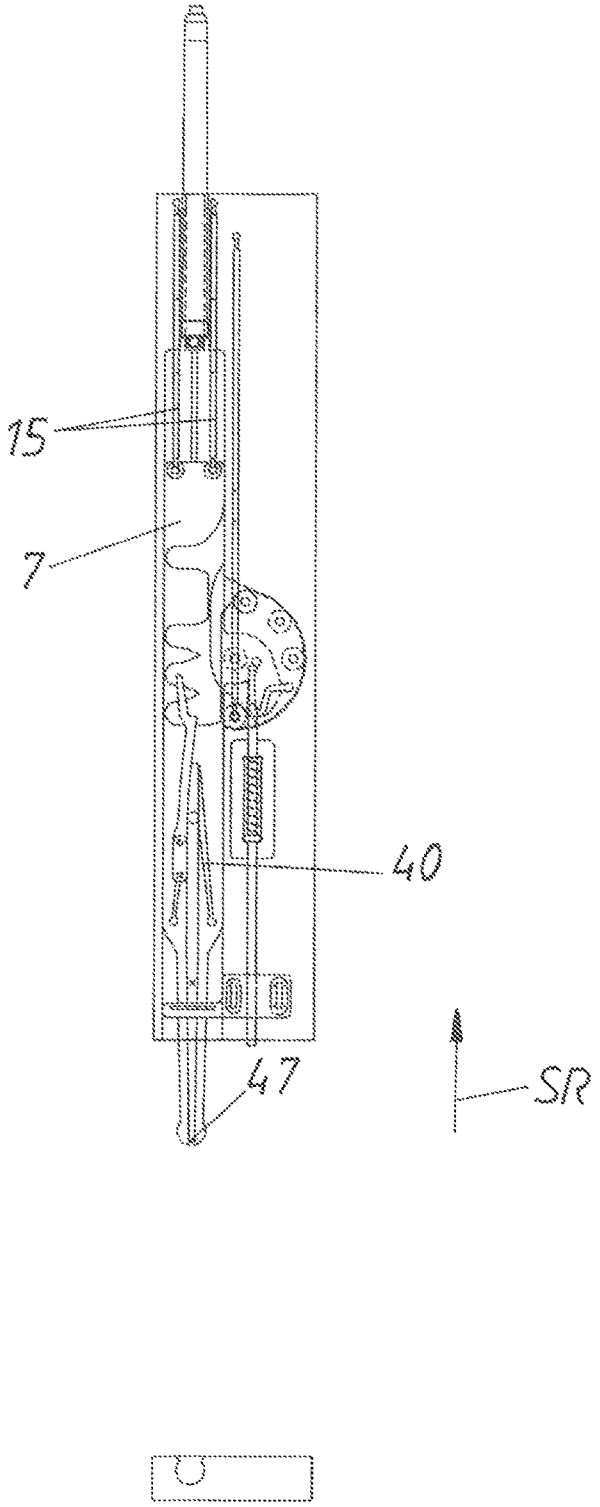

Starting from reaching this decoupling position EK, the retrieving force storage member 15 can again relax and initially moves the tensioning element 7 in the closing direction SR until reaching the position according to FIG. 35. Simultaneous with this movement or starting from the point in time when the abutment 45 no longer abuts the head portion 37, the coupling force storage member 40 can relax. AS a consequence, the tip 47 of the coupling and decoupling element 27 is moved into the head region of the coupling piece 25, whereby the head region is again being spread.

Figure 36:
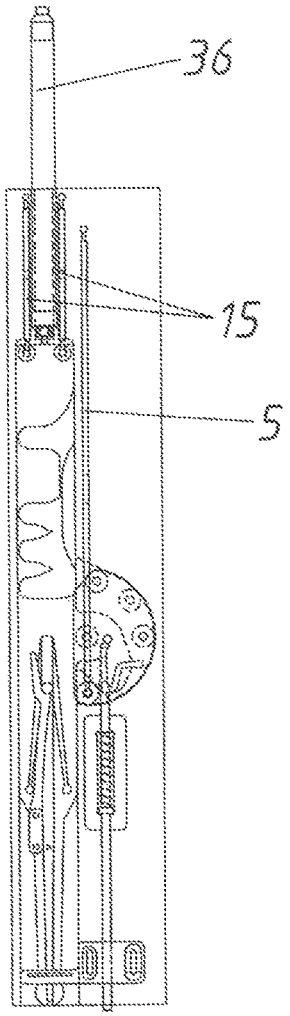

In FIG. 36 the retrieving force storage member 15 has fully relaxed. This retrieving movement is being damped by the piston of the damping device 36. Thereby, the retrieved position R of the retrieving device 13 or the retrieving force storage member 15 is reached. However, the movable furniture part 2—represented by the coupling counter piece 24—is still located in an open position OS.

Figure 37:
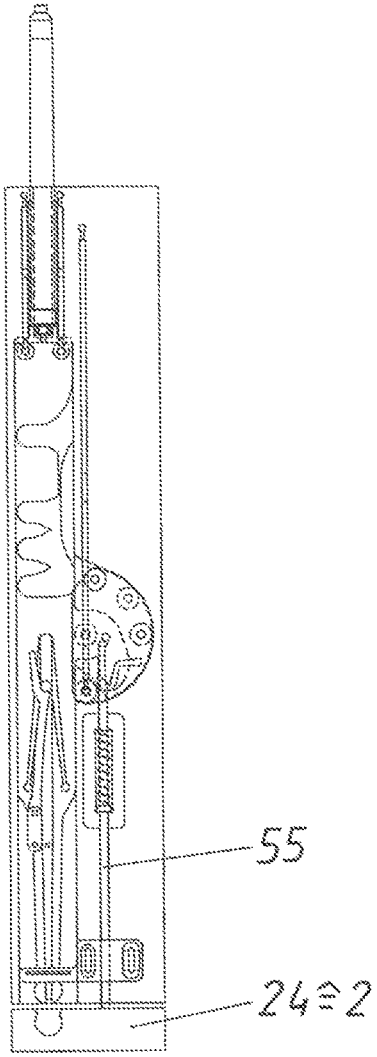
Figure 37:
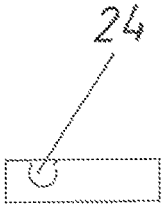

When finally, according to FIG. 37, even the movable furniture part 2 is being moved in the closing direction SR, the movable furniture part 2 arrives in the closed position SS. In this closed position SS, the coupling counter piece 24 again abuts the triggering element 55. The locking device 17 is in the locking position VS. The coupling device 26 is in the decoupling position EK. FIG. 37 corresponds again with the starting position according to FIG. 24.

Lastly, it shall be pointed out that in the embodiments the same functional components are referred to with the same reference signs. So, the advantages and mentioned possibilities to the embodiments each analogously apply to the other embodiments.

The invention claimed is:

1. An ejection device for ejecting a movable furniture part, the ejection device comprising:

a locking device including:

an ejection element for ejecting the movable furniture part from a closed position into an open position, the ejection element being rotatable about a rotary axis and being configured to be locked in a locking position in which the movable furniture part is not ejected by the ejection element, an ejection force storage member configured to force-actuate the ejection element, and a carrier force storage member base supporting the ejection force storage member; and a triggering element to be operatively arranged between the movable furniture part and the ejection element of the locking device;

wherein, in the locking position, a line of action of the ejection force storage member runs through the rotary axis, and wherein the locking device is configured to be unlocked by over-pressing the movable furniture part into an over-pressed position located beyond the closed position in a closing direction and thereby moving the rotary axis and the line of action into a relative unlocking state when the ejection element moves past the triggering element so that the rotary axis and the line of action are distanced from each other.

2. The ejection device according to claim 1, wherein the triggering element is configured to abut the ejection element, wherein the ejection element is configured to, in the event of over-pressing, be rotated by the triggering device such that the line of action and the rotary axis reach the relative unlocking state.

3. The ejection device according to claim 2, wherein, in the locking position, the triggering element abuts the ejection element.

4. The ejection device according to claim 1, wherein the ejection element is configured to be rotated by the ejection force storage member about the rotary axis starting from the relative unlocking state so that the ejection element ejects the movable furniture part in an opening direction.

5. The ejection device according to claim 4, wherein the ejection element is configured to eject the movable furniture part in opening direction indirectly via a tensioning element.

6. The ejection device according to claim 1, wherein the ejection device further comprises a carrier, and the ejection force storage member engages the carrier via the carrier force storage member base and also engages the ejection element via an ejection element force storage member base, wherein, in the locking position, the carrier force storage member base and the ejection element force storage member base are located in a plane comprising the rotary axis of the ejection element and the line of action.

7. The ejection device according to claim 1, wherein the ejection force storage member is one of a tension spring or a compression spring.

8. An item of furniture comprising:

a furniture carcass;

a movable furniture part; and the ejection device according to claim 1 for ejecting the movable furniture part.

* * * * *